US005666924A

United States Patent [19]

Kadota

[11] Patent Number: 5,666,924

[45] Date of Patent: Sep. 16, 1997

[54] MALFUNCTION DIAGNOSIS DEVICE FOR FUEL-EVAPORATED-GAS PROCESSING DEVICE

[75] Inventor: Yoichi Kadota, Himeji, Japan

[73] Assignee: Mitsubishi Denki Kabushiki Kaisha, Tokyo, Japan

[21] Appl. No.: 499,148

[22] Filed: Jul. 6, 1995

[30] Foreign Application Priority Data

Jul. 7, 1994 [JP] Japan ..... 6-156154

[51] Int. Cl.[6] ..... F02M 37/04

[52] U.S. Cl. ..... 123/520; 123/198 D; 123/479

[58] Field of Search ..... 123/198 DB, 520, 123/521, 518, 519, 516, 479, 198 D

[56] References Cited

U.S. PATENT DOCUMENTS

| | | | |
|---|---|---|---|
| 4,949,695 | 8/1990 | Uranishi et al. | 123/520 |
| 5,158,059 | 10/1992 | Kuroda | 123/479 |
| 5,230,319 | 7/1993 | Otsuka | 123/198 D |
| 5,327,873 | 7/1994 | Ohuchi et al. | 123/520 |
| 5,331,560 | 7/1994 | Tamura | 123/479 |
| 5,349,299 | 9/1994 | Kanehiro | 123/479 |
| 5,462,034 | 10/1995 | Kadota | 123/520 |

*Primary Examiner*—Carl S. Miller

*Attorney, Agent, or Firm*—Sughrue, Mion, Zinn, Macpeak & Seas

[57] ABSTRACT

When a malfunction determination mode for a fuel-evaporated-gas processing device is employed (step S1), an engine control unit 9A determines whether a malfunction of an $O_2$ sensor 10 is being checked or not (step S2). When a malfunction of the $O_2$ sensor 10 is being checked, the determination of a malfunction of the $O_2$ sensor 10 is executed (step S4) without determining a malfunction of the fuel-evaporated-gas processing device. When the $O_2$ sensor 10 malfunctions, a processing to be taken when the $O_2$ sensor 10 malfunctions is executed (step S8) and a warning lamp is turned on (step S9). With this operation reliability in the determination of a malfunction of the fuel-evaporated-gas processing device can be improved without employing a countermeasure such as an increase of the number of determinations and the like.

21 Claims, 18 Drawing Sheets

MALFUNCTION DIAGNOSIS DEVICE FOR FUEL-EVAPORATED-GAS PROCESSING DEVICE

BACKGROUND OF THE INVENTION

1. Field of the Invention

The present invention relates to a malfunction diagnosis device for a fuel-evaporated-gas processing device of, for example, a vehicle engine, and more specifically, to a malfunction diagnosis device for a fuel-evaporated-gas processing device having a function of concentrically detecting a malfunction of components or a device related to the control of an exhaust gas (hereinafter, referred to as "exhaust-gas-related-components").

2. Description of the Related Art

Recently, as greater attention has been paid to problems of terrestrial environment, there is a tendency that a gas exhausted from vehicles such as motor cars is more strictly regulated. Consequently, there must be provided a function for checking whether exhaust-gas-related-components are normally operating or not.

It is contemplated that the exhaust-gas-related-components include, for example, a fuel-evaporated-gas processing device for processing a fuel evaporated gas generated from a fuel tank, a fuel device for supplying fuel to an engine, a misfire detection device for monitoring whether fuel is normally burnt in an engine or not, and an oxygen ($O_2$) sensor as a main component necessary to feed back oxygen ($O_2$) to increase the purifying efficiency of a catalyst and the like. Although the $O_2$ sensor is also one of the components constituting the fuel device, the $O_2$ sensor will be described independently of the fuel device to make the description more understandable.

As a conventional malfunction diagnosis device for a fuel-evaporated-gas processing device mounted on a vehicle, there is proposed a device for making a determination of a malfunction independently of a malfunction determining function of other exhaust-gas-related-components such as, for example, the misfire detection device, the fuel device, the $O_2$ sensor and the like (refer to, for example, Japanese Patent Laid-Open No. 2(1990)-26754).

FIG. 12 is a view showing the arrangement of a conventional malfunction diagnosis device for a fuel-evaporated-gas processing device mounted on a vehicle.

The malfunction diagnosis device includes a fuel tank 1 filled with fuel, a pressure sensor 2 for detecting the pressure in the fuel tank 1, a canister 3 containing activated charcoal as an absorbing agent for absorbing a fuel evaporated gas generated in the fuel tank 1, a solenoid valve 4 for opening and closing a vent passage (not shown) connecting the canister 3 to the outside (atmosphere), a solenoid valve 6 located in a fuel vapor supply passage 5 between the canister 3 and an intake pipe 7 of an engine 8 for supplying the fuel evaporated gas absorbed by the canister 3 to the engine 8, and an engine control unit (hereinafter referred to as an ECU) 9 for controlling the engine 8.

The malfunction diagnosis device is mounted on an exhaust pipe 11 of the engine 8 and includes an oxygen ($O_2$) sensor 10 for detecting an air/fuel ratio of a mixture (a weight ratio of intake air sucked into the engine 8 to fuel supplied to the engine 8) and generating a corresponding output signal to the ECU 9. The ECU 9 outputs control signals to a plurality of injectors 12 provided one for each of the cylinders at the intake manifold of the engine 8 in response to an output detected by the $O_2$ sensor 10.

The malfunction diagnosis device further includes a crankshaft sensor 13 mounted on the crankshaft of the engine 8 for outputting a signal at each predetermined angle of the crankshaft and generating a corresponding output signal to the ECU 9, and a water temperature sensor 14 for detecting the temperature of the cooling water of the engine 8 and generating a corresponding output signal to the ECU 9.

The components 2–6 and 9 constitute the fuel-evaporated-gas processing device; the components 13 and 9 constitute the misfire detection device; and the components 9, 10, 12 and 14 constitute the fuel device.

Next, the operation of the above-mentioned conventional malfunction diagnosis device will be described.

First, an operation for determining a malfunction of the fuel-evaporated-gas processing device effected by detecting the pressure in the fuel tank 1 will be described with reference to FIG. 13.

A fuel evaporated gas stored in the fuel tank 1 is absorbed by the activated charcoal in the canister 3. Although the vent passage extending from the canister 3 to the atmosphere is usually opened to the atmosphere by the solenoid valve 4, when an abnormal or excessive amount of the fuel evaporated gas is absorbed by the canister 3, the vent passage is used as an emergency passage for exhausting the fuel evaporated gas to the outside of the canister 3.

The ECU 9 monitors the operating state of the engine 8 based on the information from the sensors 2, 10, 13, 14 mounted on the respective portions of the engine 8, and when the ECU 9 recognizes that the engine is operating in such a state that a fuel evaporated gas is absorbed by the canister 3, the ECU 9 determines that it is in a fuel-evaporated-gas processing device check mode (time $T_0$) and closes the vent passage of the canister 3 and the fuel vapor supply passage 5 by turning off the solenoid valves 4 and 6 to thereby close the entire fuel-evaporated-gas passage.

With this operation, since the fuel evaporated gas in the fuel tank 1 cannot escape to anywhere, the fuel tank 1 is filled with an increasing amount of the fuel evaporated gas and the pressure in the fuel tank 1 is increased to a certain level $P_0$. After this state has continued for a predetermined period of time, the solenoid valve 6 is turned on to open the fuel vapor supply passage 5 (time $T_1$) so that the fuel evaporated gas filled in the canister 3 is discharged through the canister 3 and the fuel vapor supply passage 5 to the intake pipe 7 within a predetermined time (until time $T_2$) and the high pressure in the fuel tank 1 is decreased to a predetermined low pressure $P_1$ accordingly.

Thereafter, the solenoid valve 6 is turned off to close the fuel vapor supply passage 5 again and a period of time tm necessary for the pressure in the fuel tank 1 to increase by a predetermined pressure $P_2$ is measured.

Although time tm is equal to time $t_0$ when the fuel-evaporated-gas processing device normally operates, when the fuel-evaporated-gas passage is partially damaged in the area, for example, from the fuel tank 1 to the intake pipe 7 or the solenoid valve 4 or 6 is damaged, the fuel evaporated gas leaks so that the relationship $t_m=t_1$ is established and a long time is required for the increase of the pressure in the fuel tank 1.

Consequently, the malfunction of the fuel-evaporated-gas processing device can be determined depending upon a change in the internal pressure of the fuel tank 1, i.e., whether the pressure increasing time tm is long or short.

Next, an operation for determining a malfunction of the fuel-evaporated-gas processing device effected by a change in the air fuel/ratio (A/F ratio) of the engine 8 will be described with reference to FIG. 14.

The ECU 9 determines the operating state of the engine 8 by detecting an engine rotational speed (RPM) through the crankshaft sensor 13 and an engine warming-up state through the water temperature sensor 14. When the engine operating state is such that the warming up of the engine 8 has finished and that the engine 8 is in a mode in which $O_2$ feedback control can be effected, the ECU 9 determines that the engine is in the fuel-evaporated-gas processing device check mode (time $T_{10}$), and it closes the vent passage of the canister 3 and the fuel vapor supply passage 5 by turning off the solenoid valves 4 and 6 so as to close the entire fuel-evaporated-gas passage. With this operation, the fuel evaporated gas in the fuel tank 1 cannot escape to anywhere so that the fuel tank 1 is filled with the fuel evaporated gas. After this state has continued for a predetermined period of time, the solenoid valve 6 is turned on (time $T_{11}$) to discharge the fuel evaporated gas filled in the canister 3 to the engine 8 in a moment.

On the other hand, the $O_2$ feedback control is continuously carried out in the check mode and an $O_2$ feedback control compensation amount $K_{FB}$ acts to reverse an output from the $O_2$ sensor 10 (at A/F ratio=14.7), as shown in FIG. 14, so that fuel is controlled by compensating the pulse width of a control signal supplied to the injector 12 of FIG. 12 based on the feedback control compensation amount $K_{FB}$.

When the feedback control compensation amount $K_{FB}$ is represented by $K_{FBU1}$, $K_{FBU2}$, . . . at the time an output from the $O_2$ sensor 10 is reversed from lean to rich in a fuel-evaporated-gas shut off period from the time $T_{10}$ to the time $T_{11}$ (both solenoid valves 4 and 6 are turned off) as well as when the feedback control compensation amount $K_{FB}$ is represented by $K_{FBL1}$, $K_{FBL2}$, . . . at the time the output from the $O_2$ sensor 10 is reversed from rich to lean on the contrary, an average feedback control compensation amount $K_{FBM}$ is calculated according to the following formula.

$$K_{FBM}=(K_{FBU1}+K_{FBL1})/2+(K_{FBU2}+K_{FBL2})/2+ \quad (1)$$

Thereafter, after the fuel evaporated gas is supplied to the engine 8 for a predetermined period of time from the time $T_{11}$, the feedback control compensation amount $K_{FB}$ ($K_{FB12}$) is measured (time $T_{12}$) and a difference $K_{FB}$ between the amount $K_{FB12}$ and the average feedback control compensation amount $K_{FBM}$ is calculated by the following formula.

$$\Delta K_{FB}=K_{FMB}-K_{FB12} \quad (2)$$

When the fuel-evaporated-gas processing device normally operates, the fuel evaporated gas (mixed rich gas) filled in the canister 3 from the time $T_{10}$ to the time $T_{11}$ is supplied to the engine 8 after the time $T_{11}$. To control the mixed gas to an A/F ratio of 14.7 by the $O_2$ feedback control, the feedback control compensation amount $\Delta K_{FB}$ is set to a small value (compensation to a lean value) and $K_{FB}$ is set to a large value.

When, for example, the fuel-evaporated-gas passage from the fuel tank 1 to the engine 8 is partially damaged or the solenoid valve 4 or 6 is damaged so as to allow leakage of the fuel evaporated gas, the canister 3 is not filled with a mixed rich gas from time $T_{10}$ to time $T_{11}$, so that even if the solenoid valve 6 is turned on, the A/F ratio of the mixed gas supplied to the engine 8 is not made rich after the time $T_{11}$. As a result, a compensation for making the mixed gas lean is not carried out by an $O_2$ feedback control coefficient and $K_{FB}$ is set to a small value as compared with the case where the fuel-evaporated-gas processing device normally operates.

As described above, a malfunction of the fuel-evaporated-gas processing device can be determined by monitoring an amount of change in the air/fuel ratio of a mixture supplied to the engine 8, i.e., $\Delta K_{FB}$.

Next, operation for determining a malfunction of the misfire detection device will be described with reference to FIG. 15.

The ECU 9 detects the RPM of the engine 8 by measuring a signal cycle from the output signal of the crankshaft sensor 13. When misfire takes place in the engine 8 at time $T_1$ in FIG. 15, torque is not produced in a cylinder which is misfiring, so that the RPM of the crankshaft of the engine 8 decreases, and as a result, the cycle of a signal output from the crankshaft sensor 13 is extended. Thus, when the misfire occurred at time T1, the cycle of the crankshaft sensor signal is extended to $T_{B1}$ at time $T_2$. The occurrence of the misfire is detected by an extended length of the signal cycle $T_{B1}$ beyond a predetermined misfire determination level $T_{B2}$, and thus the malfunction of a component of an ignition system can be determined.

Next, an operation for determining a malfunction of the $O_2$ sensor 10 will be described with reference to FIG. 16.

The usual $O_2$ feedback operation is carried out up to time $T_{20}$, and when an output from the $O_2$ sensor 10 is rich (A/F ratio: 14.7 or less), an amount of fuel supplied to the engine 8 is decreased, whereas when the output from the $O_2$ sensor 10 is lean (A/F ratio: 14.7 or more), an amount of fuel supplied to the engine 8 is increased, so that the amount of fuel is controlled to reverse the output from the $O_2$ sensor 10.

When it is determined that the operating state of the engine 8 is in an $O_2$ sensor malfunction determination mode (time $T_{20}$), the ECU 9 decreases the amount of fuel supplied to the engine 8 to a first predetermined amount $F_1$ for a first predetermined period of time (from time $T_{20}$ to time $T_{21}$) by controlling the injector 12 and thereafter increases the amount of fuel up to a second predetermined amount $F_2$ for a second predetermined period of time (from time $T_{21}$ to time $T_{22}$).

When the $O_2$ sensor normally operates, an output from the $O_2$ sensor 10 decreases to a level $V_{L1}$ at time $T_{21}$ (i.e., when a lean period has finished) and thereafter reaches a preset determination level $V_{TH}$ or higher in a period of time $t_{h1}$.

When the $O_2$ sensor 10 is deteriorated, it is a general phenomenon that an output voltage thereof decreases or an output thereof delays in response. Therefore, with the deteriorated $O_2$ sensor, an output from the $O_2$ sensor decreases only to a level $V_{L2}$ at the time $T_{21}$ (when a lean period has finished) or a long period of time $t_{h2}$ is required for the output to reach the determination level $V_{TH}$ or higher, and thus the deterioration of the $O_2$ sensor can be determined.

Next, an operation for determining a malfunction of the fuel device will be described with reference to FIG. 17.

In the fuel device for carrying out $O_2$ feedback control, an output from the $O_2$ sensor 10 is made larger than 0.5 V when the detected A/F ratio is smaller than 14.7 (rich), whereas when the A/F ratio is greater than 14.7 (lean), the output is made smaller than 0.5 V. Thus, an amount of fuel to be supplied to the engine 8 is controlled to reverse an output from the $O_2$ sensor 10 so as to set the A/F ratio to 14.7 (an optimum value in the performance of the engine operation or combustion) as described in the above determination of the malfunction of the $O_2$ sensor 10. For example, an $O_2$ feedback control compensation amount is realized by an integration compensation for gradually increasing or decreasing an amount of fuel with respect to a time factor, as shown in FIG. 17.

When the respective components of the fuel device usually operates normally (up to time $T_{40}$), the feedback control compensation amount acts in the vicinity of 1.0. However, when an amount of fuel is compensated to achieve an A/F of 14.7 by carrying out the $O_2$ feedback control at the time a component of the fuel device such as the injector 12 or the like is deteriorated, compensation is made to reduce a difference (an amount corresponding the deteriorated characteristics) between the characteristics of the deteriorated component and a corresponding normal component so that the amount of the feedback control compensation is shifted, as shown after time $T_{41}$. Therefore, a degree of deterioration of the respective components of the fuel device can be detected from the shift amount of the feedback control compensation amount.

Since the conventional malfunction diagnosis device for the fuel-evaporated-gas processing device is arranged as described above, it has the following problems.

That is, when a malfunction of the $O_2$ sensor is determined, an amount of fuel to be supplied to the engine 8 is forcibly decreased during the period from time $T_{20}$ to Time $T_{21}$, so that if this period coincides with, for example, the period from the time $T_{11}$ to the time $T_{12}$ (i.e., the period during which the fuel evaporated gas accumulated in the canister 3 is supplied to the engine 8 in a moment), as shown in FIG. 14, the compensations of fuel in both periods are canceled out and a mixed gas supplied to the engine 8 is not made rich. Thus, since the $O_2$ feedback control compensation amount is made small regardless of whether the fuel-evaporated-gas processing device normally operates, there is a possibility that the fuel-evaporated-gas processing device is erroneously determined to be malfunctioning.

When the engine 8 is operating in such an unstable combustion state, misfiring may take place in the engine 8 so an uncombusted gas is emitted from the engine 8, making it impossible to correctly detect the A/F ratio. As a result, the $O_2$ feedback control compensation amount often exhibits an erroneous behavior. Likewise, when the $O_2$ sensor 10 itself malfunctions, the $O_2$ feedback control compensation amount controlled by an output from the $O_2$ sensor also exhibits an erroneous behavior. Further, when the fuel device malfunctions, the $O_2$ feedback control compensation amount is greatly displaced from a center value which is contemplated to set the A/F ratio to the vicinity of 14.7, the reliability of the $O_2$ feedback control compensation amount is also lowered in this case.

When the malfunction of the fuel-evaporated-gas processing device is determined by the A/F ratio detection system of FIG. 14, the $O_2$ feedback control compensation amount is used as a parameter for the determination of a malfunction. Thus, when the engine 8 operates in such a state that the $O_2$ feedback control compensation amount exhibits an erroneous behavior or an unreliably low value, it is difficult to correctly determine a malfunction of the fuel-evaporated-gas processing device.

After the beginning of the fuel-evaporated-gas processing device malfunction determination mode, the amount of the fuel evaporated gas filled in the canister 3 in a period (a period of time from time $T_0$ to time $T_1$ in FIG. 13 or a period of time from time $T_{10}$ to time $T_{11}$ in FIG. 14) during which the canister 3 is filled with the evaporated gas varies depending upon the operating state of the engine 8.

FIG. 18 shows the effect caused by the amount of the fuel evaporated gas generated in the fuel tank 1 when a malfunction of the fuel-evaporated-gas processing device is determined or checked. A normal state A shows the behavior of the pressure in the fuel tank 1 and the $O_2$ feedback control compensation amount $K_{FB}$ when the fuel evaporated gas is not sufficiently absorbed by the canister 3. When there is a small amount of fuel evaporated gas in the fuel tank 1, however, even if the fuel-evaporated-gas passage is shut off, the pressure in the fuel tank 1 less increases, and even if a fuel evaporated gas stored thereafter is supplied to the engine 8, the A/F ratio is less affected by the fuel evaporated gas because the gas has a low concentration and thus a behavior shown by a normal state B in FIG. 18 is taken.

Even if the pressure in the fuel tank 1 changes around the time when the solenoid valve 6 is turned on and off, the A/F ratio of the fuel evaporated gas accumulated in the canister 3 is not always made rich depending upon the operating state of the engine 8 and thus there may be a case where the A/F ratio behaves as shown by the normal state B similarly to the aforesaid.

As a result, the behavior of the pressure in the fuel tank 1 and the $O_2$ feedback control compensation amount $K_{FB}$ are near or like the behaviors taken in malfunction (broken line in FIG. 18) as compared with the case of the normal operation A, and since the pressure in the fuel tank 1 and the $O_2$ feedback control compensation amount $K_{FB}$ less change, it may be difficult to set a malfunction determination value.

When the pressure in the fuel tank 1 and the $O_2$ feedback control compensation amount $K_{FB}$ are changed by an error in the detection system or other factors, there is a possibility that a malfunction is erroneously determined in a worst case.

SUMMARY OF THE INVENTION

The present invention is intended to solve the aforementioned problems and has for its object the provision of a malfunction diagnosis device for a fuel-evaporated-gas processing device which is capable of improving reliability in the determination of a malfunction of the fuel-evaporated-gas processing device without employing any countermeasure such as an increase in the number of determinations and the like.

According to a first aspect of the present invention, there is provided a malfunction diagnosis device for a fuel-evaporated-gas processing device which absorbs a fuel evaporated gas in a fuel tank to an absorbing agent and supplies the fuel evaporated gas thus absorbed to an engine through a fuel-evaporated-gas passage with a valve disposed therein, said malfunction diagnosis device comprising: malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for prohibiting the determination of a malfunction of said fuel-evaporated-gas processing device while a malfunction of any of exhaust-gas-related-components other than said fuel-evaporated-gas processing device is checked.

According to a second aspect of the present invention, there is provided a malfunction diagnosis device for a fuel-evaporated-gas processing device which absorbs a fuel evaporated gas in a fuel tank to an absorbing agent and supplying the fuel evaporated gas thus absorbed to an engine through a fuel-evaporated-gas passage with a valve disposed therein, said malfunction diagnosis device comprising: malfunction determination means for determining a malfunction of said fuel-evaporated-gas processing device based on pressures in said fuel tank detected when said valve is opened and closed or an amount of change in an air/fuel ratio of a air/fuel mixture supplied to said engine; and determination processing means for invalidating, when any of exhaust-gas-related-components other than said fuel-evaporated-gas processing device malfunctions, the result of the determination of a malfunction of said fuel-evaporated-gas processing device which has been effected in the same malfunction checking cycle.

With the above arrangements, adverse effects caused by the determination of a malfunction of the exhaust-gas-related-components other than the fuel-evaporated-gas processing device can be avoided and thus reliability in the determination of a malfunction of the fuel-evaporated-gas processing device can be improved.

According to a third aspect of the present invention, there is provided a malfunction diagnosis device for a fuel-evaporated-gas processing device which absorbs a fuel evaporated gas in a fuel tank to an absorbing agent and supplying the fuel evaporated gas thus absorbed to an engine through a fuel-evaporated-gas passage with a valve disposed therein, said malfunction diagnosis device comprising: malfunction determination means for determining a malfunction of said fuel-evaporated-gas processing device based on pressures in said fuel tank detected when said valve are opened and closed or an amount of change in an air/fuel ratio of an air/fuel mixture supplied to said engine; and determination processing means for stopping a malfunction determination processing for said fuel-evaporated-gas processing device when any of exhaust-gas-related-components other than said fuel-evaporated-gas processing device malfunctions.

With this arrangement, adverse effects caused by the determination of a malfunction of the exhaust-gas-related-components other than the fuel-evaporated-gas processing device can also be avoided and thus reliability in the determination of a malfunction of the fuel-evaporated-gas processing device can be improved similarly. Further, adverse effects caused by the determination of a malfunction of the fuel-evaporated-gas processing device can be avoided by determining a malfunction of any of the exhaust-gas-related-components other than the fuel-evaporated-gas processing device again after the determination of a malfunction of the fuel-evaporated-gas processing device has been stopped and therefore reliability in the determination of a malfunction of the other exhaust-gas-related-components can be improved.

According to a fourth aspect of the present invention, there is provided a malfunction diagnosis device for a fuel-evaporated-gas processing device which absorbs a fuel evaporated gas in a fuel tank to an absorbing agent and supplying the fuel evaporated gas thus absorbed to an engine through a fuel-evaporated-gas passage with a valve disposed therein, said malfunction diagnosis device comprising: malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for determining a period of time for prohibiting the determination of malfunction after the start of said engine based on an operating state of said engine, said determination processing means being operable to prohibit the determination of a malfunction of said fuel-evaporated-gas processing device for said period of time after the engine starting.

According to a fifth aspect of the present invention, there is provided a malfunction diagnosis device for a fuel-evaporated-gas processing device which absorbs a fuel evaporated gas in a fuel tank to an absorbing agent and supplies the fuel evaporated gas thus absorbed to an engine through a fuel-evaporated-gas passage with a valve disposed therein, said malfunction diagnosis device comprising: malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for determining a period of time for prohibiting the determination of malfunction after the start of said engine based on an integrated value of an amount of air sucked by said engine after the start thereof, said determination processing means being operable to prohibit the determination of a malfunction of said fuel-evaporated-gas processing device for said period of time after the engine starting.

According to a sixth aspect of the present invention, there is provided a malfunction diagnosis device for a fuel-evaporated-gas processing device which absorbs a fuel evaporated gas in a fuel tank to an absorbing agent and supplies the fuel evaporated gas thus absorbed to an engine through a fuel-evaporated-gas passage with a valve disposed therein, said malfunction diagnosis device comprising: malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for determining a period of time for prohibiting the determination of malfunction after the start of said engine based on at least one of an operating state of said engine and an integrated value of an amount of air sucked by said engine after the start thereof, said determination processing means being operable to prohibit the determination of a malfunction of said fuel-evaporated-gas processing device for said period of time after the engine starting.

With the above arrangements, since the malfunction of the fuel-evaporated-gas processing device can be determined in the state that a fuel evaporated gas is sufficiently absorbed to the absorbing agent, the malfunction can be determined in a reliable manner.

In a preferred form of the invention, the exhaust-gas-related-components other than the fuel-evaporated-gas processing device comprise a fuel device, a misfire detection device and an $O_2$ sensor.

With this arrangement, since the malfunction of the fuel-evaporated-gas processing device is not determined at least while a malfunction of the $O_2$ sensor is determined by forcibly shifting the air/fuel (A/F) ratio, adverse effects caused by the determination of a malfunction of the $O_2$ sensor can be avoided even if a malfunction of the fuel-evaporated-gas processing device is determined by a change in the A/F ratio of the mixture and thus reliability in the determination of a malfunction of the fuel-evaporated-gas processing device can be improved. Further, when it is determined that the fuel device, the misfire detection device or when the $O_2$ sensor malfunctions by which the A/F ratio or the internal pressure of the fuel tank is changed, the information on the malfunction of the fuel-evaporated-gas processing device which has been determined is canceled, so that adverse effects caused by the malfunction of the fuel device and the like can be avoided, thus improving the reliability in the determination of a malfunction of the fuel-evaporated-gas processing device.

DESCRIPTION OF PREFERRED EMBODIMENTS

Embodiments of a malfunction diagnosis device for a fuel-evaporated-gas processing device according to the present invention will be described below with reference to the accompanying drawings.

Embodiment 1

Figure 1:
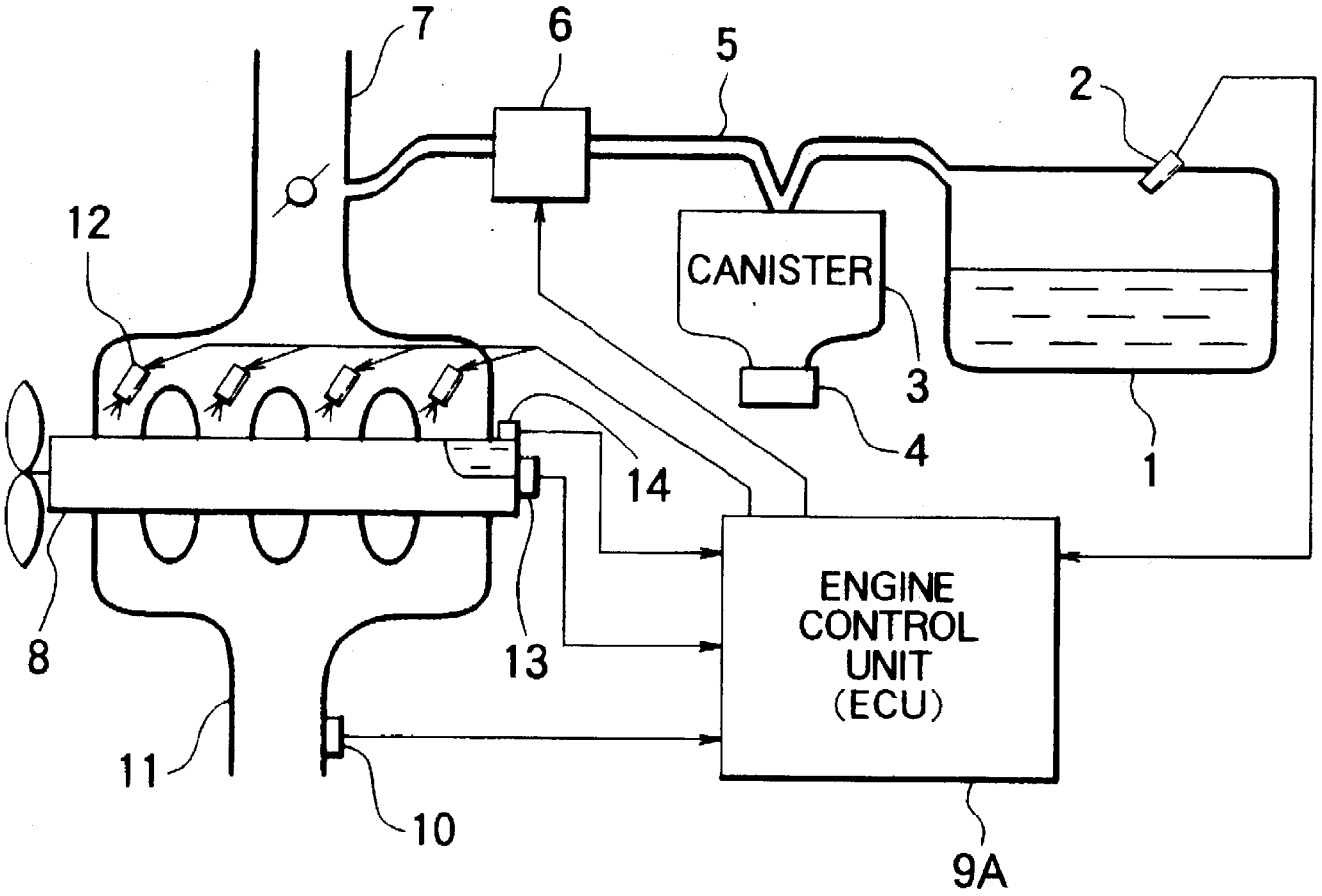
FIG. 1 is a schematic view showing the overall arrangement of a first embodiment of a malfunction diagnosis device for a fuel-evaporated-gas processing device according to the present invention.

FIG. 1 illustrates the arrangement of a malfunction diagnosis device for a fuel-evaporated-gas processing device according to a first embodiment of the present invention. In FIG. 1, the same symbols as employed in FIG. 12 are used to denote corresponding components and thus a detailed description thereof is omitted.

Figure 12:
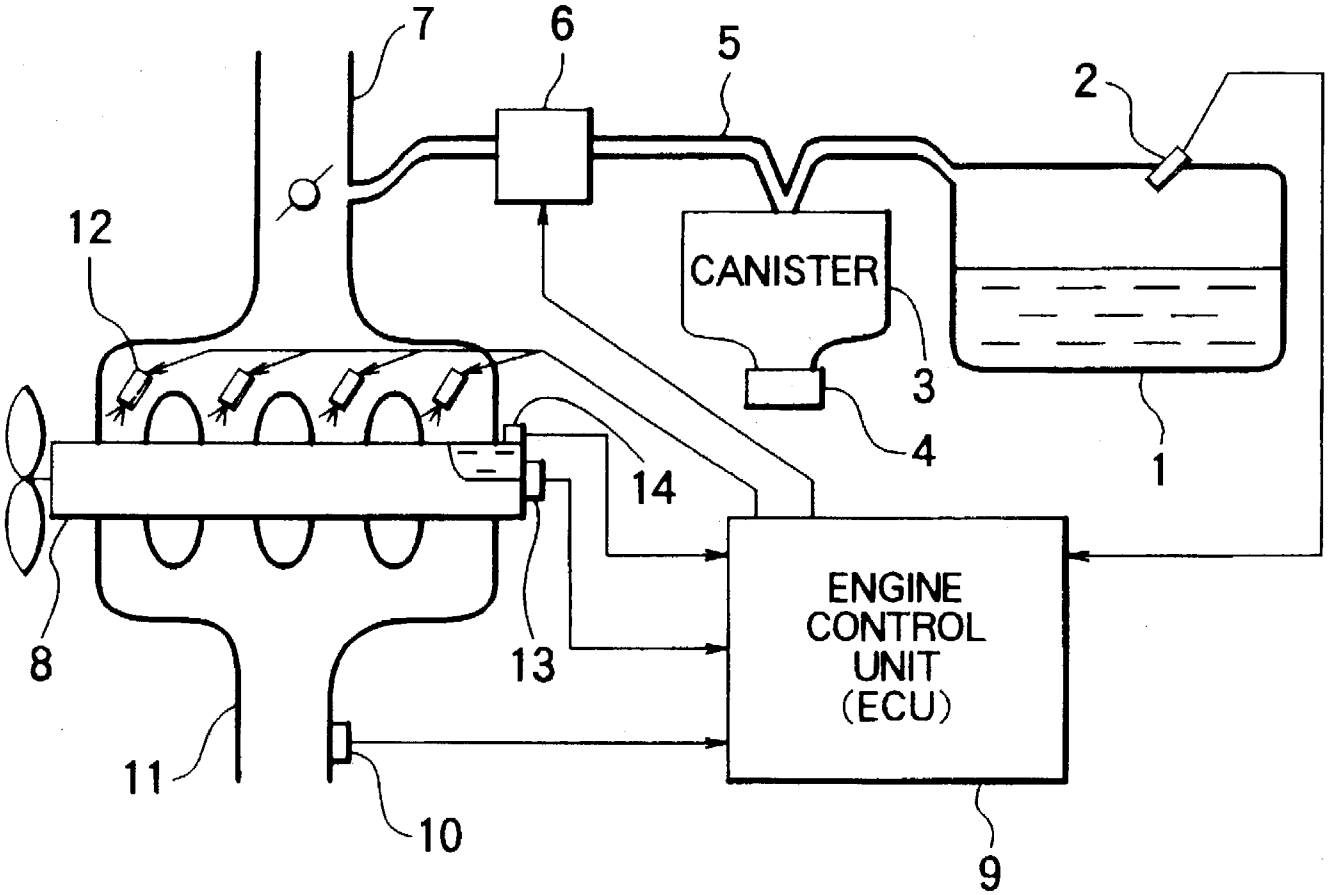
FIG. 12 a schematic view showing the arrangement of a conventional malfunction diagnosis device for a fuel-evaporated-gas processing device mounted on a vehicle.
Figure 13:
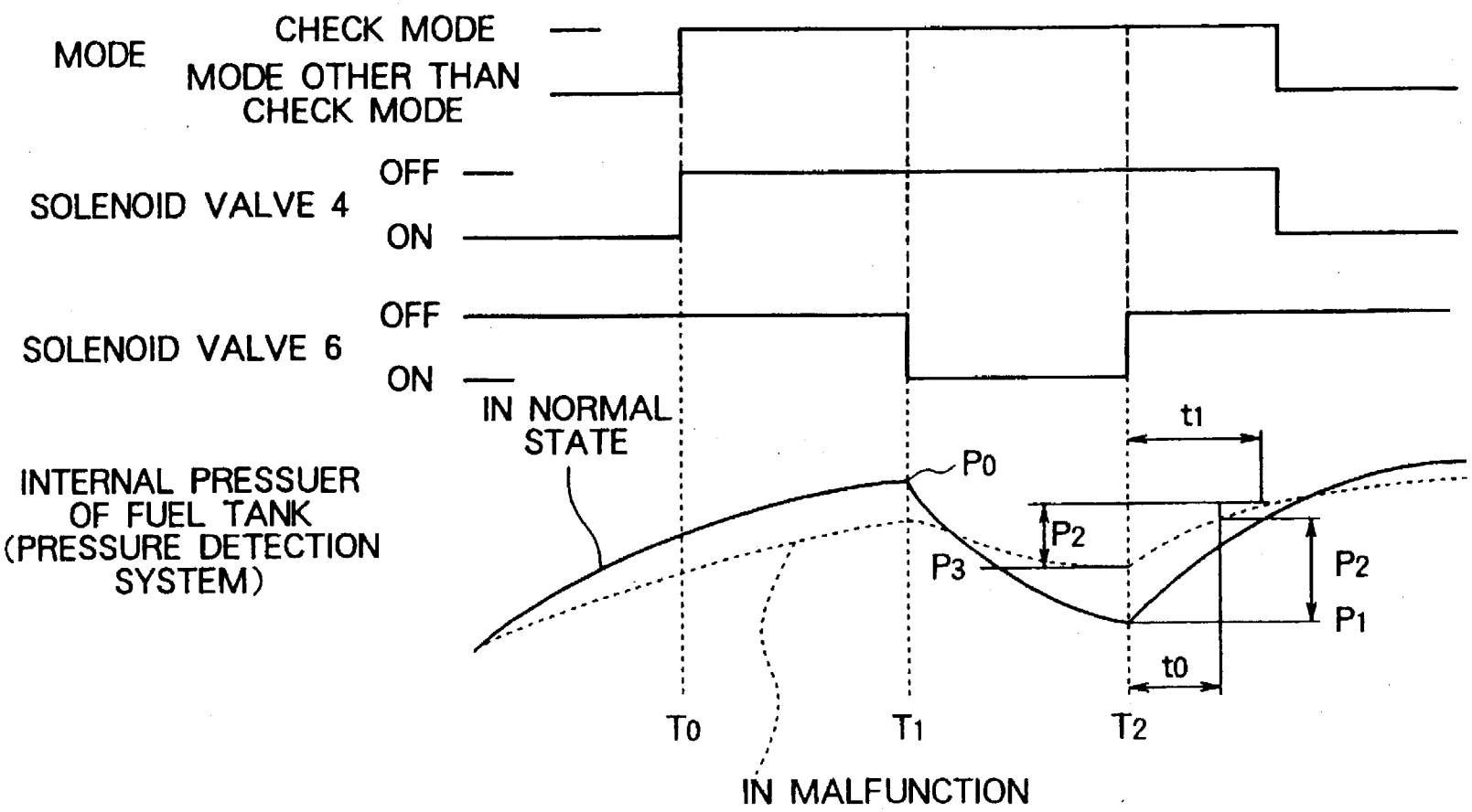
FIG. 13 is a chart showing an operation of the conventional malfunction diagnosis device for determining a malfunction of the fuel-evaporated-gas processing device based on a change in the pressure in a fuel tank.
Figure 14:
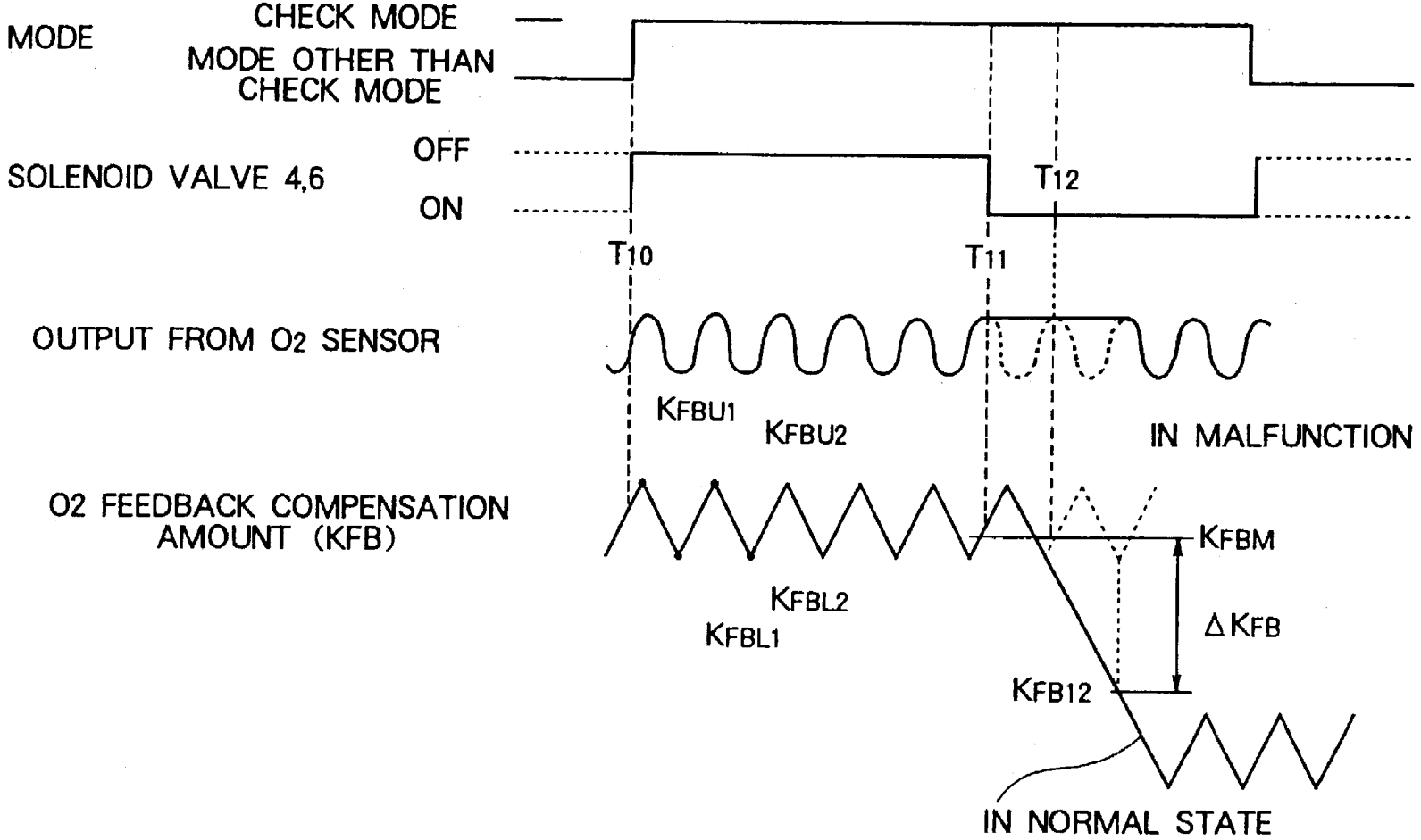
FIG. 14 is a chart showing an operation of the conventional malfunction diagnosis device for determining a malfunction of a fuel-evaporated-gas processing device by an amount of change in the A/F ratio of a mixture supplied to the engine.
Figure 15:
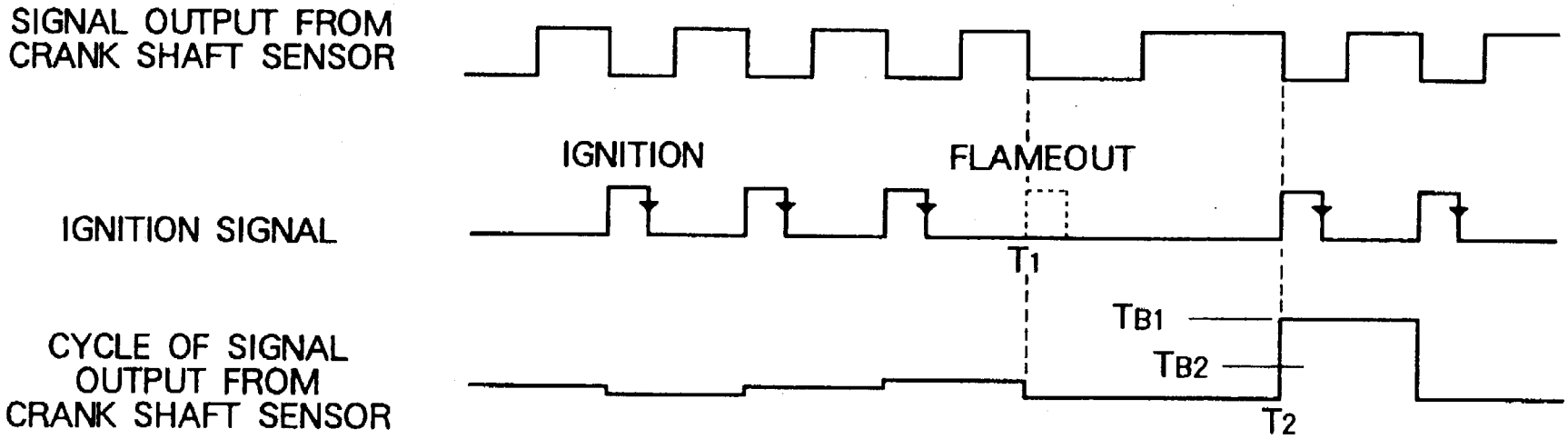
FIG. 15 is a chart showing an operation of the conventional malfunction diagnosis device for determining a malfunction of a misfire detection device.

In FIG. 1, an ECU 9A corresponds to the ECU 9 in the example shown in FIG. 12. The ECU 9A contains malfunction diagnosis means for the fuel-evaporated-gas processing device and determination processing means.

In this embodiment, a malfunction of the fuel-evaporated-gas processing device is not determined during the time when a malfunction determination mode for an $O_2$ sensor 10 as an exhaust-gas-related-component other than the fuel-evaporated-gas processing device is employed. In this regard, it is to be noted that components 2 to 6 and the ECU 9A together constitute the fuel-evaporated-gas processing device; a component 13 and the ECU 9A together constitute a misfire detection device; and components 10, 12, 14 and the ECU 9A together constitute a fuel device.

Figure 2:
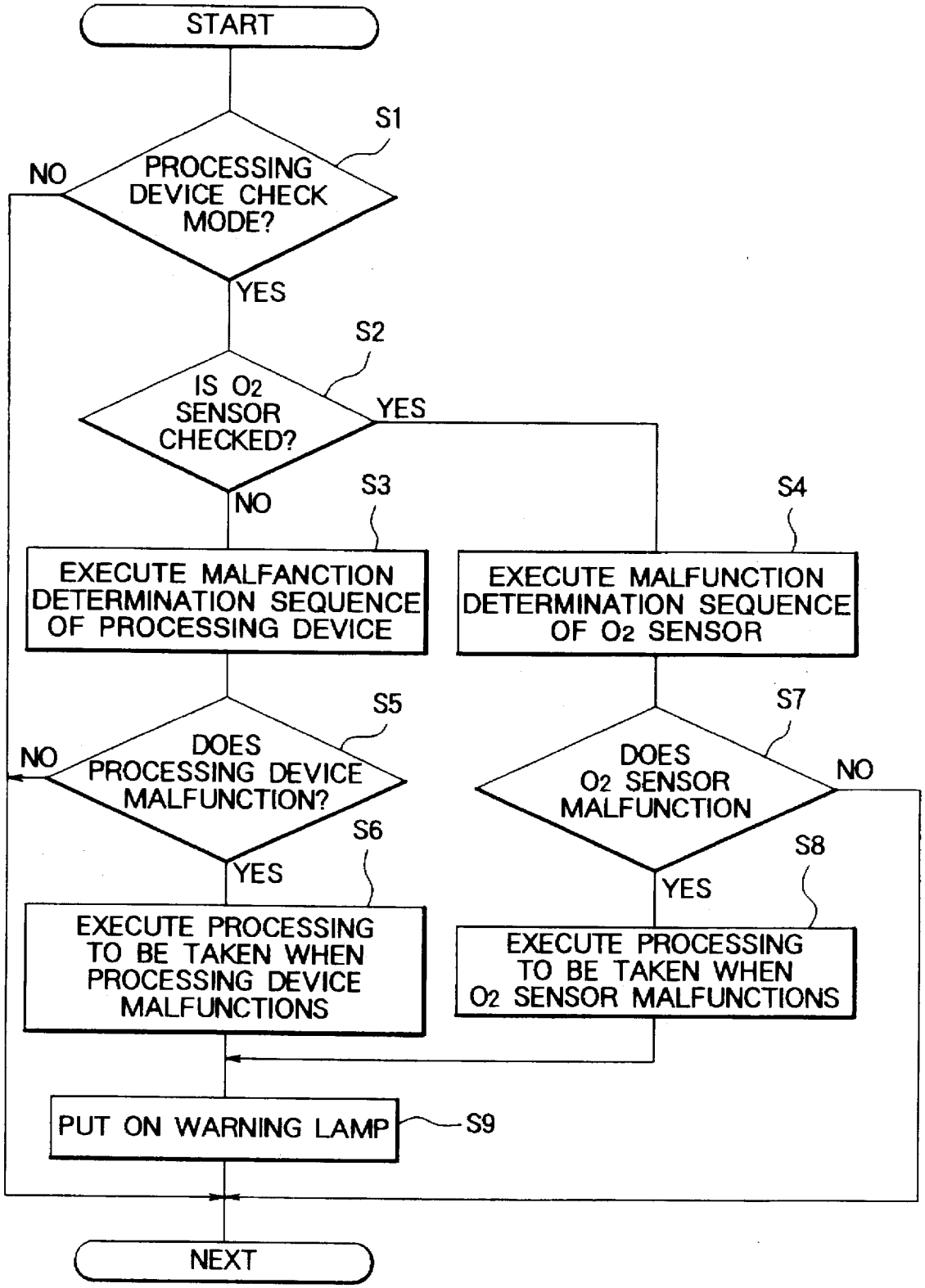
FIG. 2 is a flowchart explaining the operation of the first embodiment.

FIG. 2 is a flowchart showing an operation of the ECU 9A.

First, it is determined whether or not a malfunction diagnosis mode of the fuel-evaporated-gas processing device (i.e., a mode for checking the fuel-evaporated-gas processing device) is employed (step S1), and when the malfunction diagnosis mode for the fuel-evaporated-gas processing device is employed, it is determined whether a malfunction of the $O_2$ sensor 10 is being checked or not (step S2).

When it is determined at step S2 that a malfunction of the $O_2$ sensor is not being determined, a malfunction determination sequence of the fuel-evaporated-gas processing device to be described below is executed (step S3). When the fuel-evaporated-gas processing device malfunctions, a processing to be taken when the fuel-evaporated-gas processing device malfunctions is executed (steps S5 and S6) and a warning lamp (not shown) is turned on (step S9).

Figure 16:
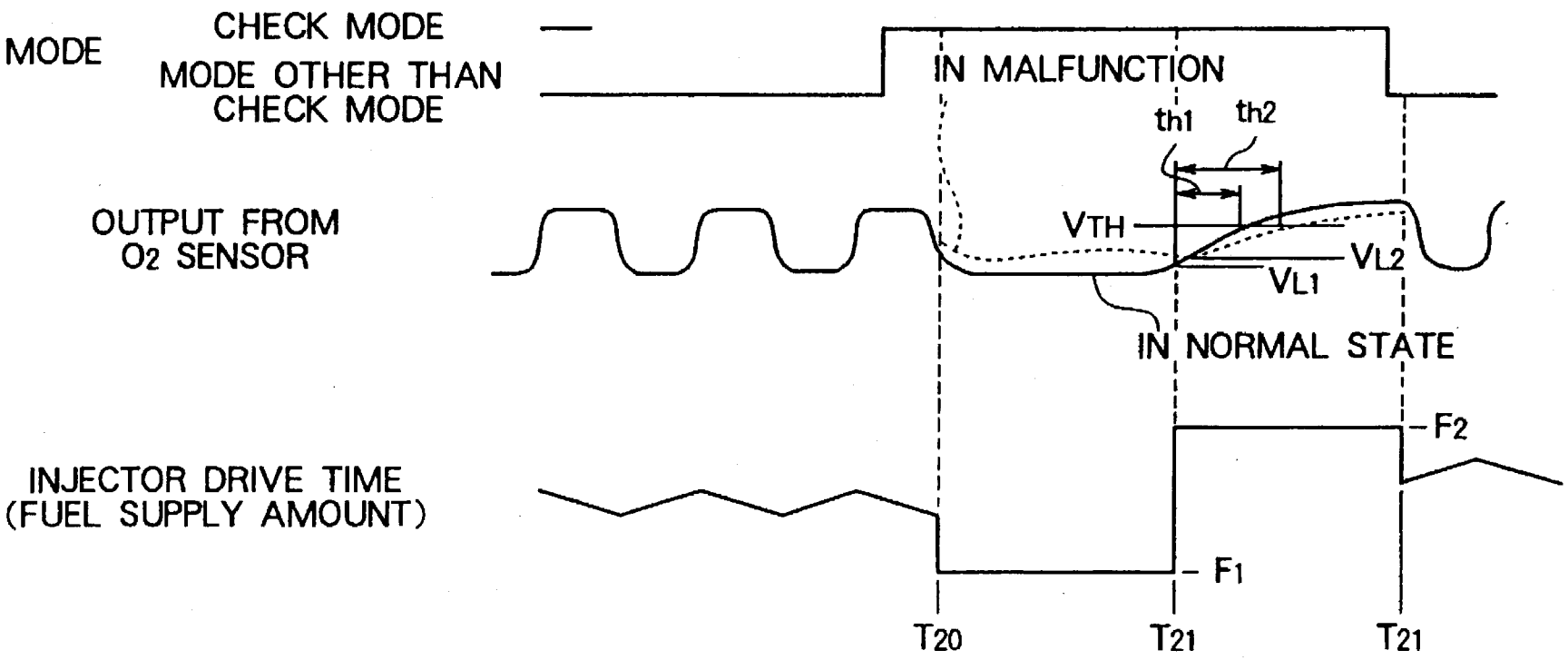
FIG. 16 is a chart showing an operation of the conventional malfunction diagnosis device for determining a malfunction of an $O_2$ sensor.
Figure 17:
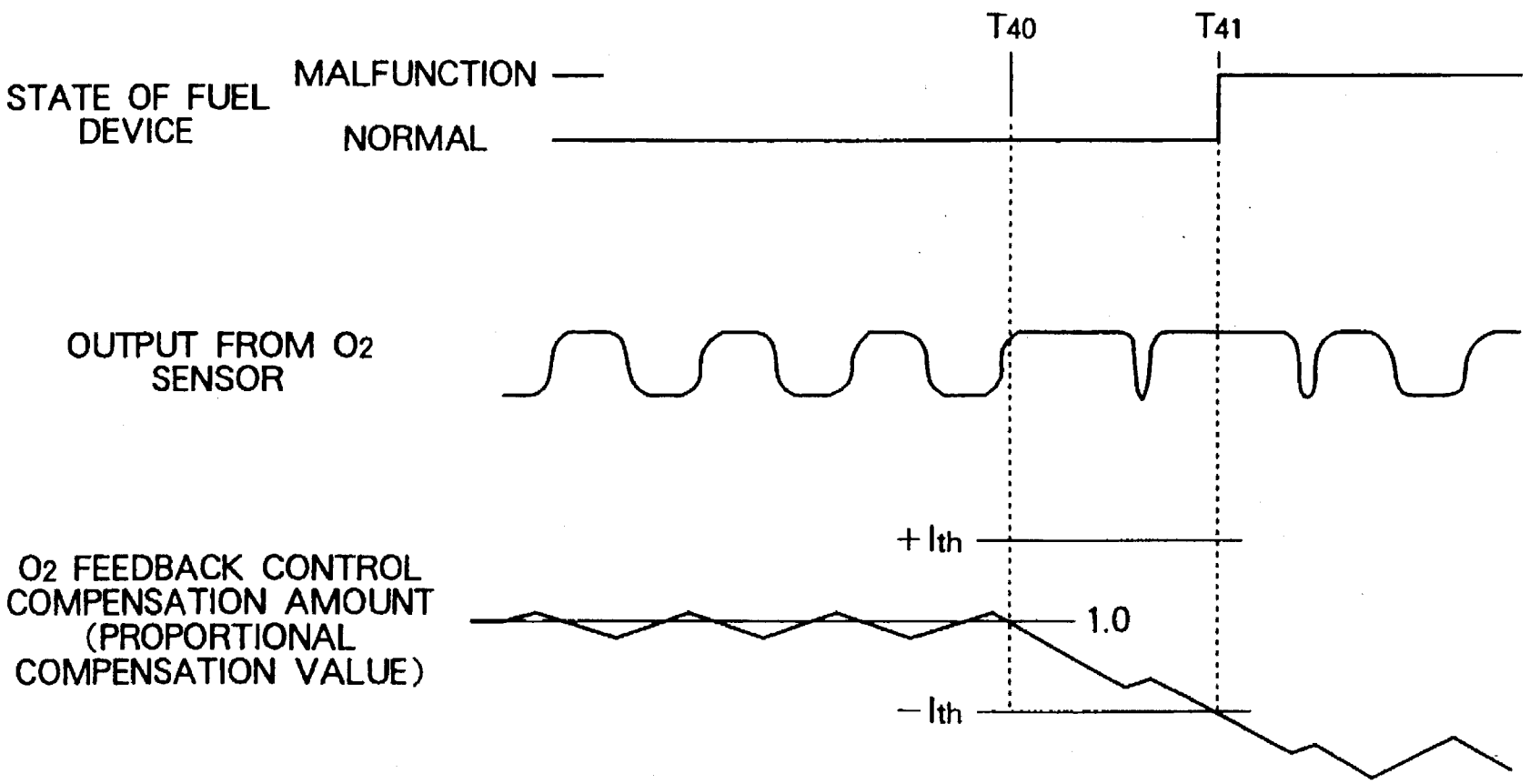
FIG. 17 is a chart showing an operation of the conventional malfunction diagnosis device for determining a malfunction of a fuel device.
Figure 18:
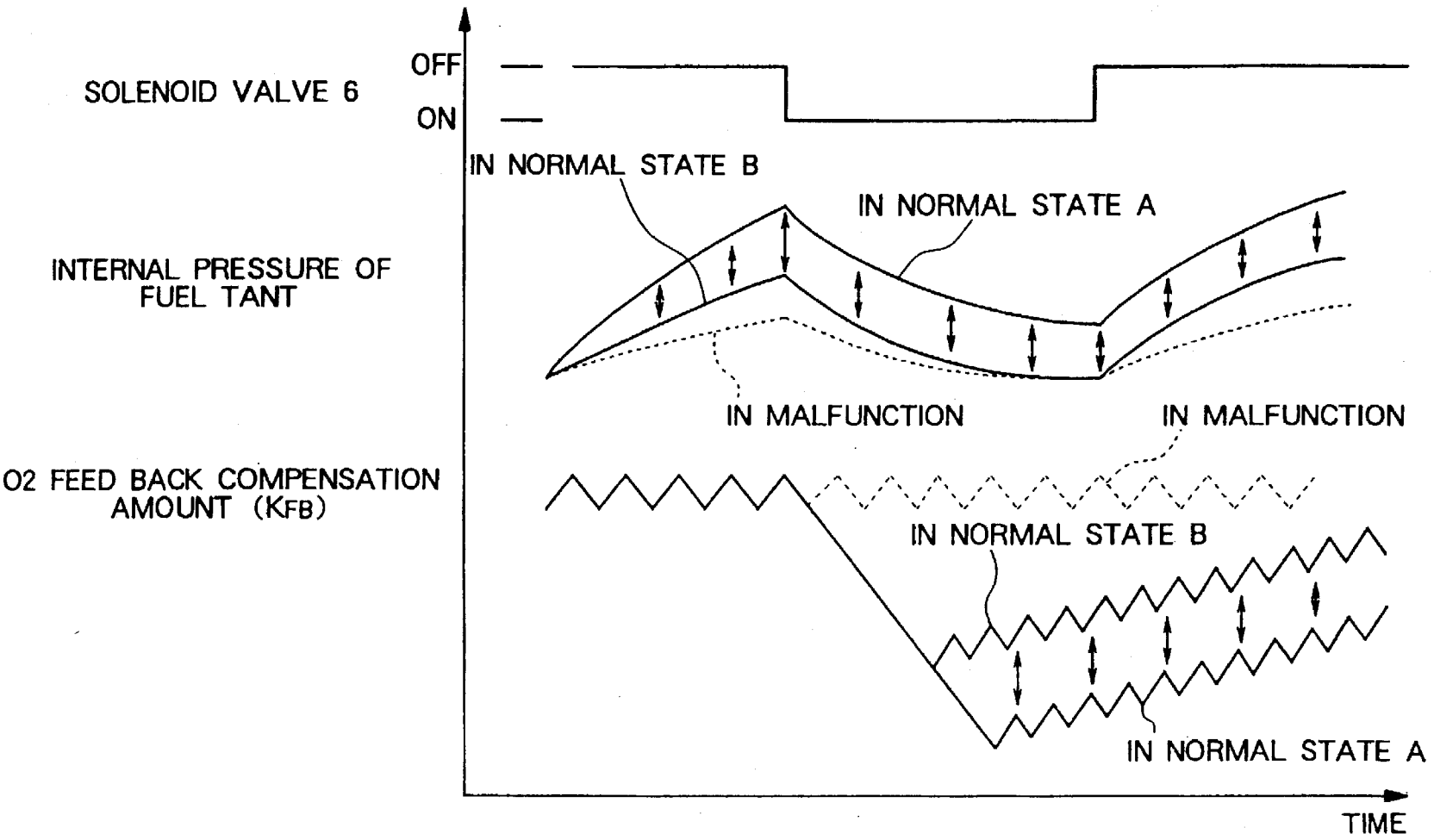
FIG. 18 is a chart showing the effect of the conventional malfunction diagnosis device caused by an amount of a fuel evaporated gas generated in a fuel tank.

When a malfunction of the $O_2$ sensor is being determined at step S2, a malfunction determination sequence of the $O_2$ sensor 10 explained with reference to FIG. 16 is executed (step S4). When the $O_2$ sensor 10 malfunctions, a processing to be taken when the $O_2$ sensor 10 malfunctions is executed (steps S7 and S8) and the warning lamp is turned on (step S9).

Note, when the malfunction determination mode for the fuel-evaporated-gas processing device is not employed at step S1, when the fuel-evaporated-gas processing device does not malfunction at step S5 and when the $O_2$ sensor 10 does not malfunction at step S7, the process goes to the next processing at once.

Figure 3:
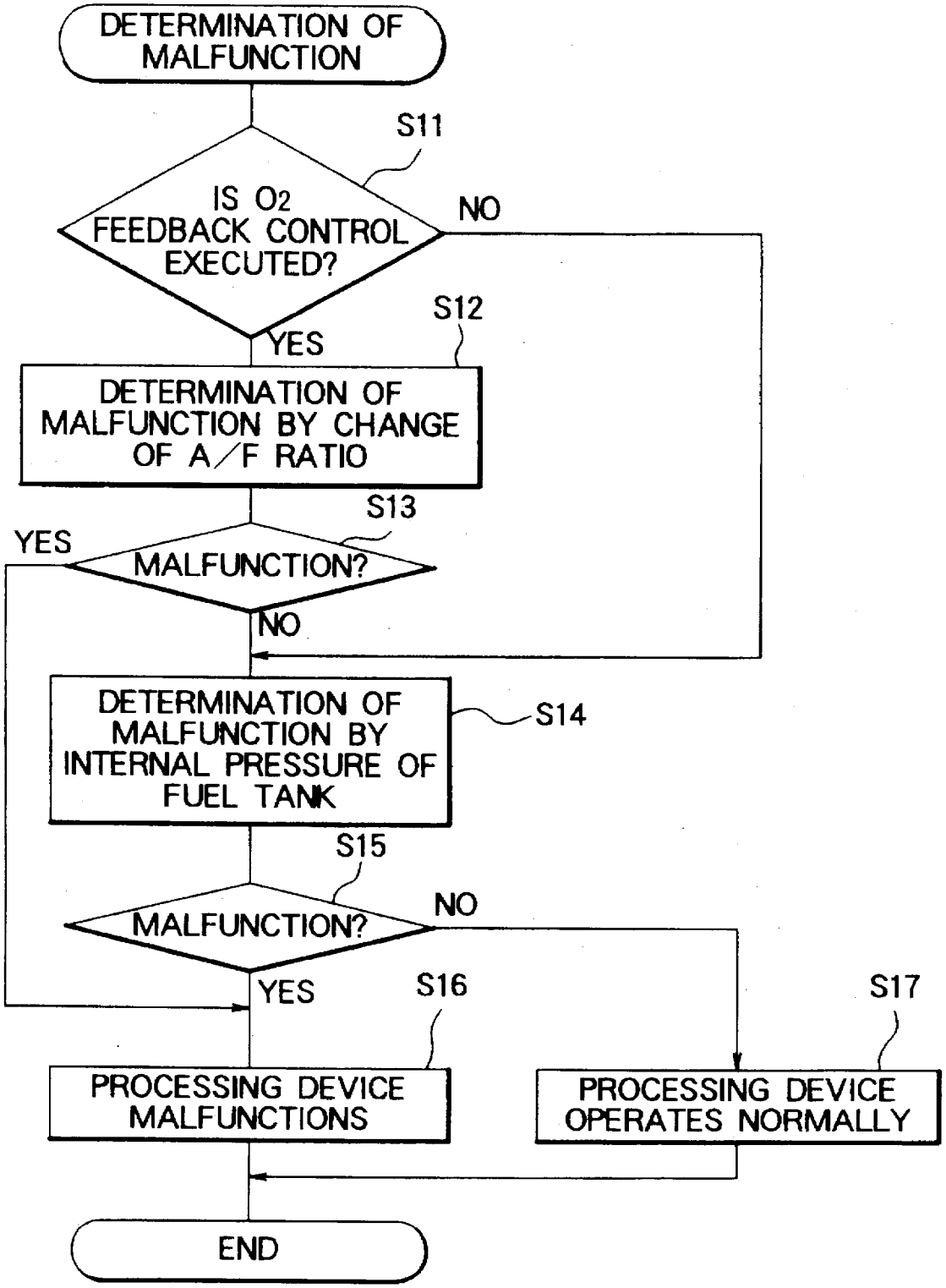
FIG. 3 is a flowchart explaining a malfunction determination sequence of the fuel-evaporated-gas processing device.

The malfunction determination sequence of the fuel-evaporated-gas processing device will be described here with reference to the flowchart of FIG. 3.

First, it is determined whether an $O_2$ feedback control is being carried out or not (step S11). When the $O_2$ feedback control is being carried out, a malfunction determination processing for the fuel-evaporated-gas processing device is carried out by a variation in the A/F ratio (step S12).

Next, when it is determined that the fuel-evaporated-gas processing device does not malfunction at step S13, the process goes to step S14. When the $O_2$ feedback control is not being carried out, the process also goes to step S14.

At step S14, a malfunction determination processing for the fuel-evaporated-gas processing device is carried out by the pressure in the fuel tank 1.

Next, when it is determined that the fuel-evaporated-gas processing device malfunctions at step S15, a processing to be taken when the fuel-evaporated-gas processing device malfunctions is carried out (step S16). When it is determined that the fuel-evaporated-gas processing device malfunctions at step 13, the process also goes to step S16 in which the processing to be taken when the fuel-evaporated-gas processing device malfunctions is carried out.

When it is determined that the fuel-evaporated-gas processing device does not malfunction at step S15, a processing to be taken when the fuel-evaporated-gas processing device normally operates is carried out (step S17).

Since the A/F ratio must be forcibly shifted to determine a malfunction of the $O_2$ sensor 10 as described above, a change in the A/F ratio is caused.

As described above, since in this embodiment, a malfunction of the fuel-evaporated-gas processing device is not determined at the time when a malfunction of the $O_2$ sensor 10 is checked, the reliability in the determination of a malfunction of the fuel-evaporated-gas processing device can be improved.

Although in the above-mentioned first embodiment, the description is made with respect to the $O_2$ sensor as the exhaust-gas-related-components other than the fuel-evaporated-gas processing device, the present invention can also be applied to a component other than the $O_2$ sensor such as, for example, a fuel device and a misfire device or a combination thereof in the same way with the same advantage.

Embodiment 2

Figure 4:
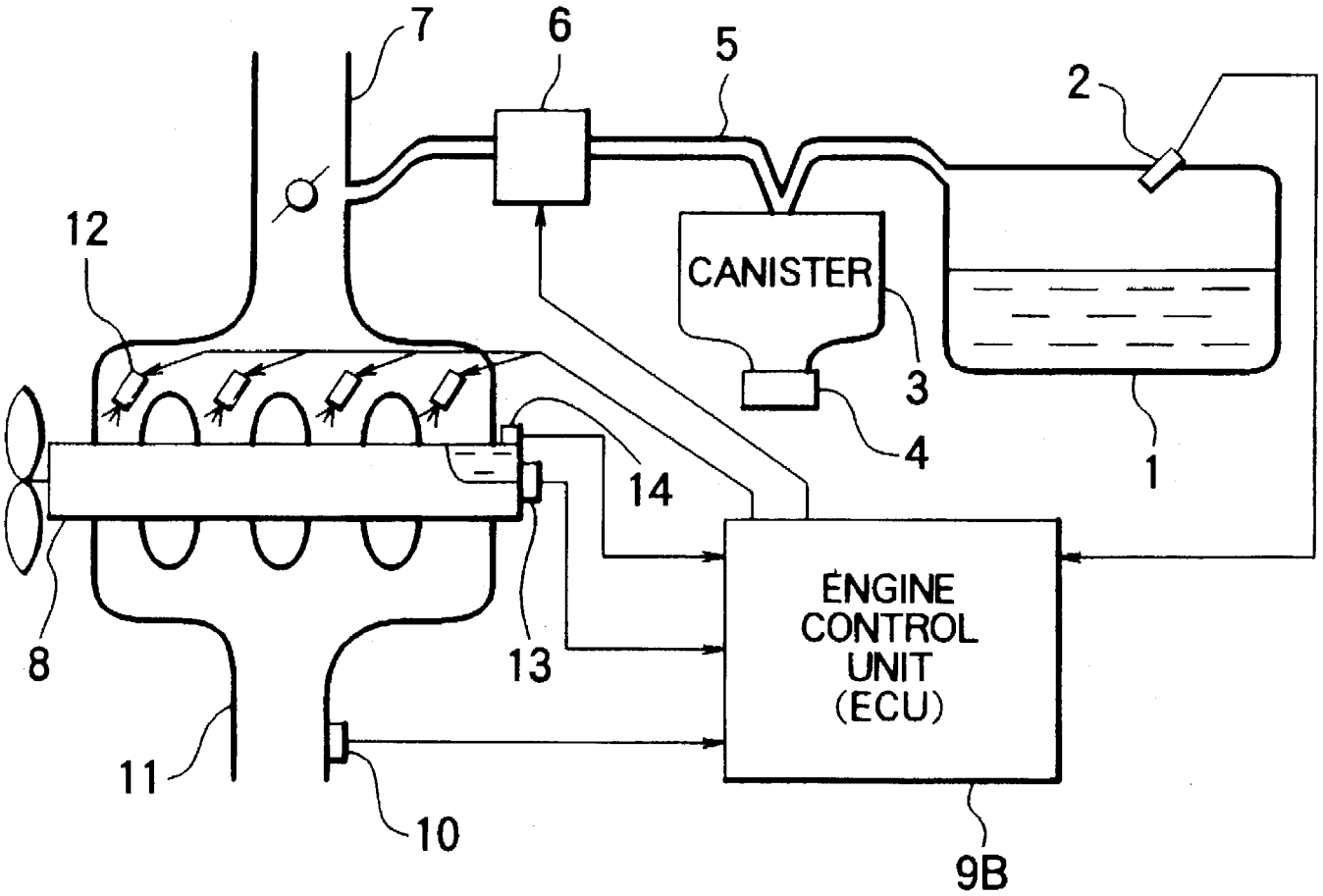
FIG. 4 is a schematic view showing the arrangement of a malfunction diagnosis device for a fuel-evaporated-gas processing device according to a second embodiment of the present invention.

FIG. 4 illustrates the arrangement of a malfunction diagnosis device for a fuel-evaporated-gas processing device according to a second embodiment of the present invention. In FIG. 4, the same symbols as employed in FIG. 12 are used to denote corresponding components and thus a detailed description thereof is omitted. In this regard, it is to be noted that components 2–6 and an ECU 9B together constitute a fuel-evaporated-gas processing device; a component 13 and the ECU 9B together constitute a misfire detection device; and components 10, 12 and 14 and the ECU 9B together constitute a fuel device.

In FIG. 4, the ECU 9B corresponds to the ECU 9 in the example shown in FIG. 12. The ECU 9B contains malfunction diagnosis means for the fuel-evaporated-gas processing device and determination processing means.

In this embodiment, when the misfire detection device malfunctions, or when the $O_2$ sensor malfunctions, or when the fuel device malfunctions, information on the detected malfunction of the fuel-evaporated-gas processing device is canceled.

Figure 5:
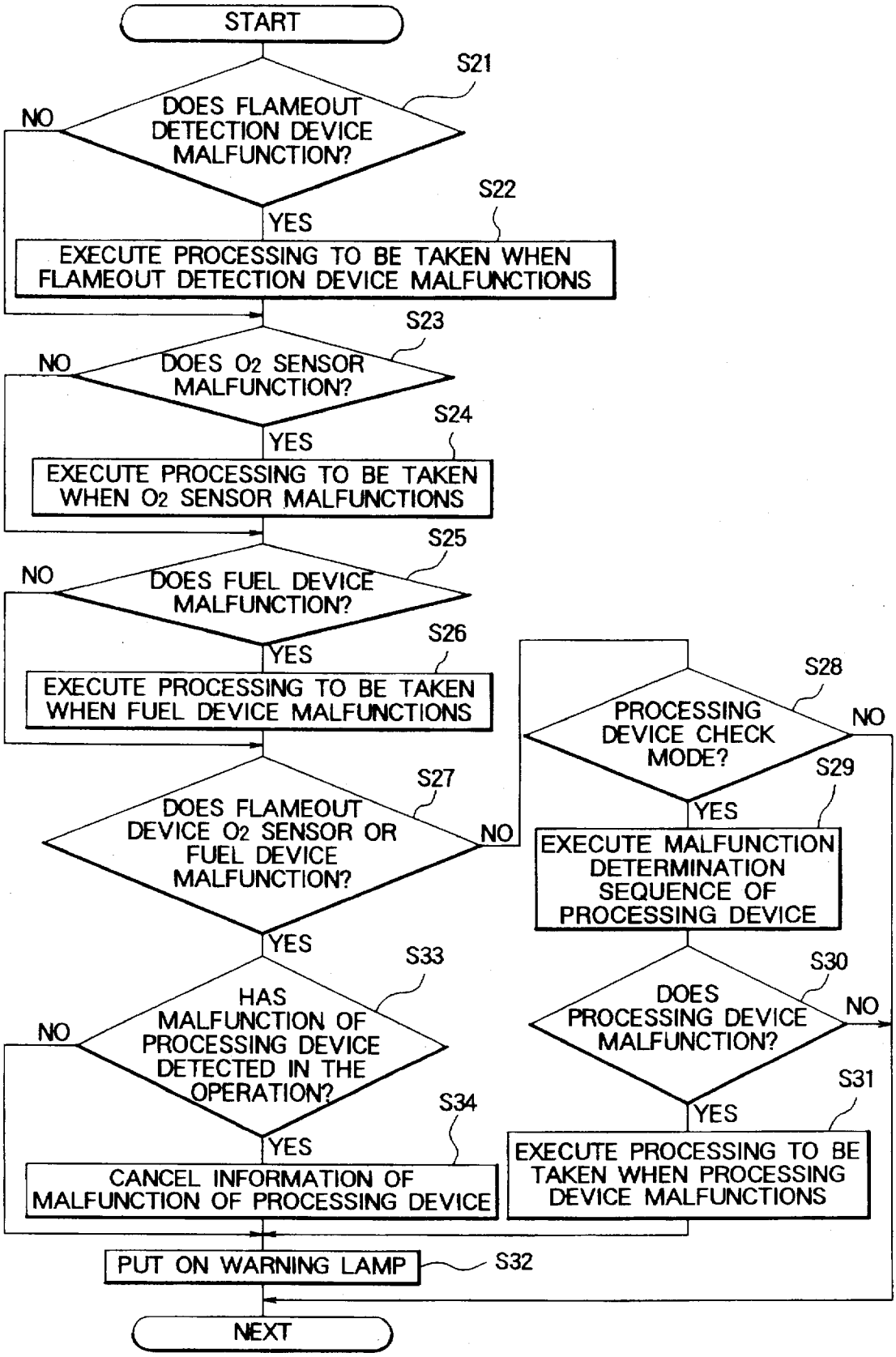
FIG. 5 is a flowchart explaining the operation of the second embodiment.

FIG. 5 is a flowchart showing the operation of the ECU 9B.

First, it is determined whether the misfire detection device malfunctions or not (step S21), and when the misfire detection device malfunctions, the process executes a processing to be taken when the misfire detection device malfunctions (step S22). Further, when it is determined that the misfire detection device does not malfunction at step S21, the process goes to step S23.

Next, it is determined whether the $O_2$ sensor 10 malfunctions (step S23), and when the $O_2$ sensor malfunctions, the process executes a processing to be taken when the $O_2$ sensor malfunctions (step S24). Further, when the $O_2$ sensor 10 does not malfunction at step S23, the process goes to step S25.

Next, it is determined whether the fuel device malfunctions or not(step S25), and when the fuel device malfunctions, the process executes a processing to be taken when the fuel device malfunctions (step S26). Further, when the fuel device does not malfunction at step S25, the process goes to step S27.

Next, when any one of the misfire detection device, the $O_2$ sensor and the fuel device is determined to be malfunctioning (step S27), and when all the exhaust-gas-related-components normally operate, it is determined whether a malfunction determination mode for the fuel-evaporated-gas processing device is employed or not (step S28). When the malfunction determination mode for the fuel-evaporated-gas processing device is employed, a malfunction determination sequence for the fuel-evaporated-gas processing device is executed according to the flowchart of FIG. 3 (step S29). Then, when the fuel-evaporated-gas processing device malfunctions, a processing to be taken when the fuel-evaporated-gas processing device malfunctions (steps S30 and S31) is carried out and a warning lamp is turned on (step S32).

When any of the exhaust-gas-related-components malfunctions at step S27 and a malfunction of the fuel-evaporated-gas processing device has been detected in the same operation, the information on a malfunction of the fuel-evaporated-gas processing device is canceled (steps S33 and S34) and the warning lamp is turned on due to the malfunction of one of the exhaust-gas-related-components other than the fuel-evaporated-gas processing device (step S32). Note, when a malfunction of the fuel-evaporated-gas processing device has not been detected in the same operation, the process goes to step S32 and turns off the warning lamp.

Further, when the malfunction determination mode of the fuel-evaporated-gas processing device is not employed at step S28 and when the fuel-evaporated-gas processing device does not malfunction at step S30, the process skips to the next processing at once.

Incidentally, when it is determined that one of the exhaust-gas-related-components other than the fuel-evaporated-gas processing device malfunctions, there is a possibility that the A/F ratio is varied in a process up to the malfunction and it is contemplated that reliability in the result of the malfunction determination is low even if the malfunction of the fuel-evaporated-gas processing device has been determined in the same operation.

When the result of a malfunction determination is represented by a certain probability and there is a possibility that the result is erroneous, a method is employed which finally determines the malfunction by carrying out a plurality of malfunction determinations. However, when a fuel evaporated gas is forcibly introduced temporarily into the engine 8 to shift or change the A/F ratio for accurate determination of malfunction, as in the case of the determination of a malfunction of the fuel-evaporated-gas processing device, an exhaust gas is deteriorated during the period.

To cope with this problem, according to this embodiment, when it is determined that any one of the exhaust-gas-related-components other than the fuel-evaporated-gas processing device malfunctions, the information on the malfunction of the fuel-evaporated-gas processing device which has been determined in the same operation is canceled. Thus, a highly reliable determination of malfunction of the fuel-evaporated-gas processing device can be carried out, and the number of processings for determining a malfunction can be decreased, thereby reducing a deterioration in an exhaust gas discharged from the engine 8 which would otherwise be induced during an extended length of the processings.

Embodiment 3

Figure 6:
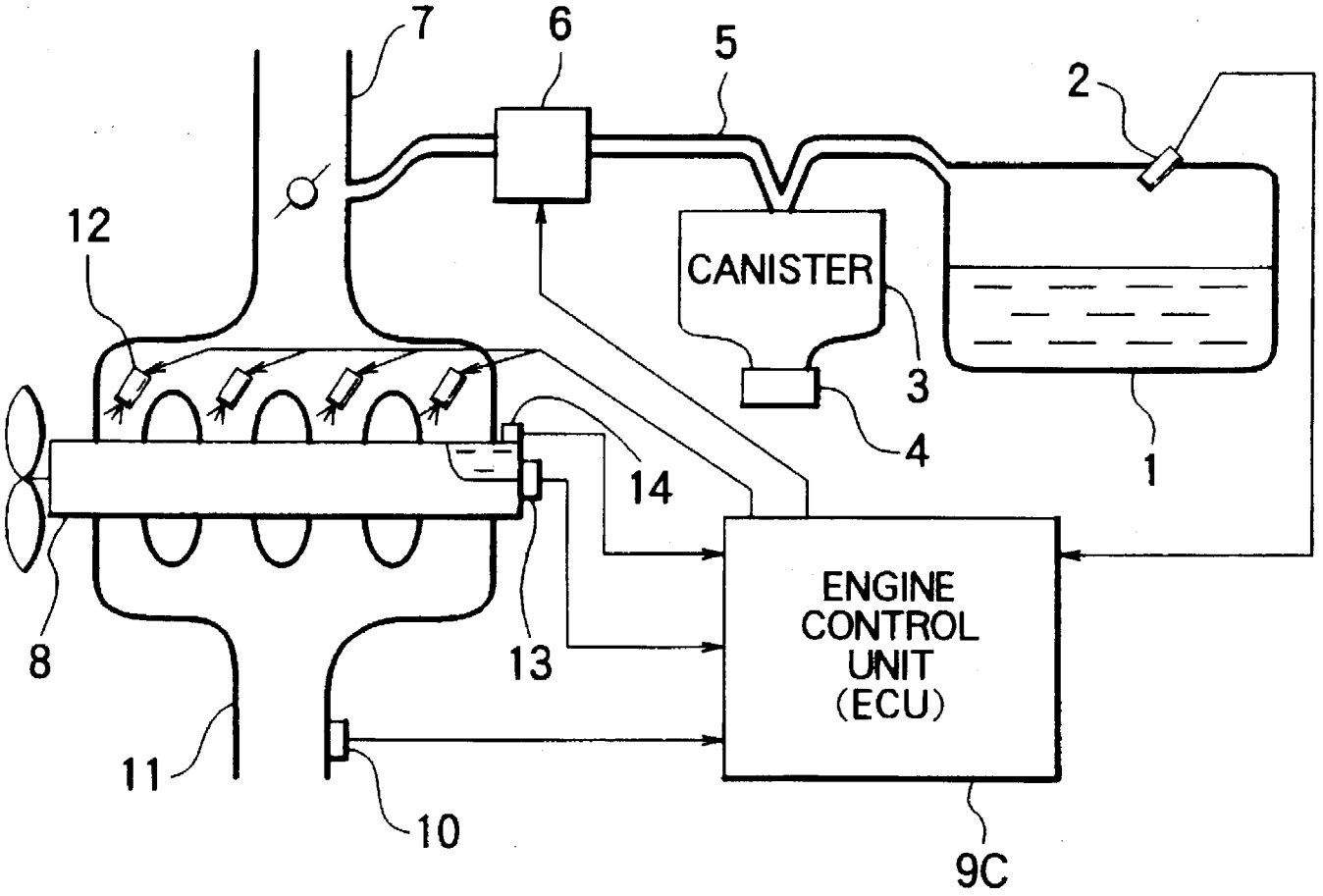
FIG. 6 is a schematic view showing the arrangement of a malfunction diagnosis device for a fuel-evaporated-gas processing device according to a third embodiment of the present invention.

FIG. 6 is a view showing the arrangement of a third embodiment of the malfunction diagnosis device for the fuel-evaporated-gas processing device according to the present invention. In FIG. 6, the same symbols as employed in FIG. 12 are used to denote corresponding components and thus a detailed description thereof is omitted.

In FIG. 6, an ECU 9C corresponds to the ECU 9 in the example shown in FIG. 12. The ECU 9C contains malfunction diagnosis means for a fuel-evaporated-gas processing device and determination processing means.

Here, it is to be noted that components 2–6 and the ECU 9C together constitute the fuel-evaporated-gas processing device; a component 13 and the ECU 9C together constitute a misfire detection device and components 10, 12 and 14 and the ECU 9C constitute a fuel device. In this embodiment, when a malfunction of the fuel device as another exhaust-gas-related-component is determined during the time when a malfunction of the fuel-evaporated-gas processing device is checked, the determination of a malfunction of the fuel-evaporated-gas processing device is stopped.

Figure 7:
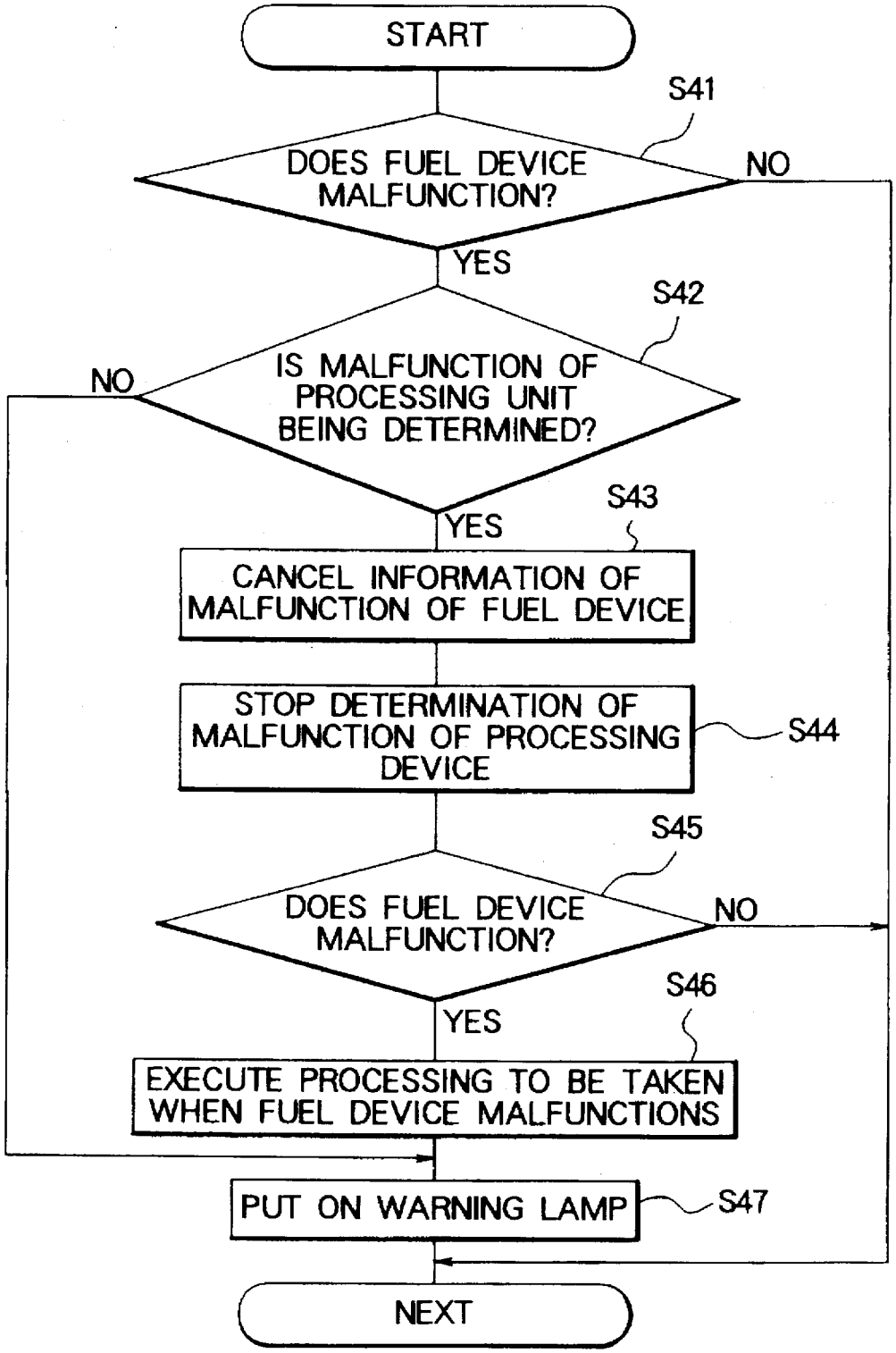
FIG. 7 is a flowchart explaining the operation of the third embodiment.

FIG. 7 is a flowchart showing the operation of the ECU 9C.

First, it is determined whether the fuel device malfunctions or not (step S41), and when the fuel device malfunctions, it is determined whether a malfunction of the fuel-evaporated-gas processing device is being checked or not (step S42).

When the malfunction of the fuel-evaporated-gas processing device is being checked or determined at step S42, information on the malfunction of the fuel device is canceled because there is a possibility that a malfunction of the fuel device cannot be normally or correctly checked due to the forcible introduction into engine 8 of a fuel evaporated gas for the determination of a malfunction of the fuel-evaporated-gas processing device (step S43).

Next, after the determination or check of a malfunction of the fuel-evaporated-gas processing device is stopped (step S44), a malfunction of the fuel device is determined or checked gain (step S45), and when the fuel device malfunctions, a processing to be taken when the fuel device malfunctions is executed (step S46) and a warning lamp is turned on (step S47).

Here, it is to be noted that when it is not determined that the fuel device malfunctions at step S41, the process goes to the next processing at once. Further, when a malfunction of the fuel-evaporated-gas processing device is not being determined or checked at step S42, the process goes to step S47 and the warning lamp is turned on because the fuel device malfunctions.

As described above, according to this embodiment, if a malfunction of the fuel-evaporated-gas processing device is being checked or determined when the fuel device is determined to be malfunctioning, the determination of a malfunction of the fuel-evaporated-gas processing device is stopped so that adverse effects caused by the malfunction of the fuel device can be avoided, thus enabling a highly reliable determination of malfunction of the fuel-evaporated-gas processing device.

Further, when it is determined that the fuel device malfunctions during the time when a malfunction of the fuel-evaporated-gas processing device is being determined or checked, the result of determination of the malfunction of the fuel device is canceled and then a malfunction of the fuel device is checked again after the determination or check of a malfunction of the fuel-evaporated-gas processing device is stopped. As a result, reliability in the determination of a malfunction of the fuel device can be increased.

Although in the above-mentioned third embodiment, the description is made with respect to the fuel device as an exhaust-gas-related-component other than the fuel-evaporated-gas processing device, the present invention can also be applied to a component other than the fuel device such as, for example, an $O_2$ sensor and a misfire device or a combination thereof in the same way with the same advantage.

Embodiment 4

Figure 8:
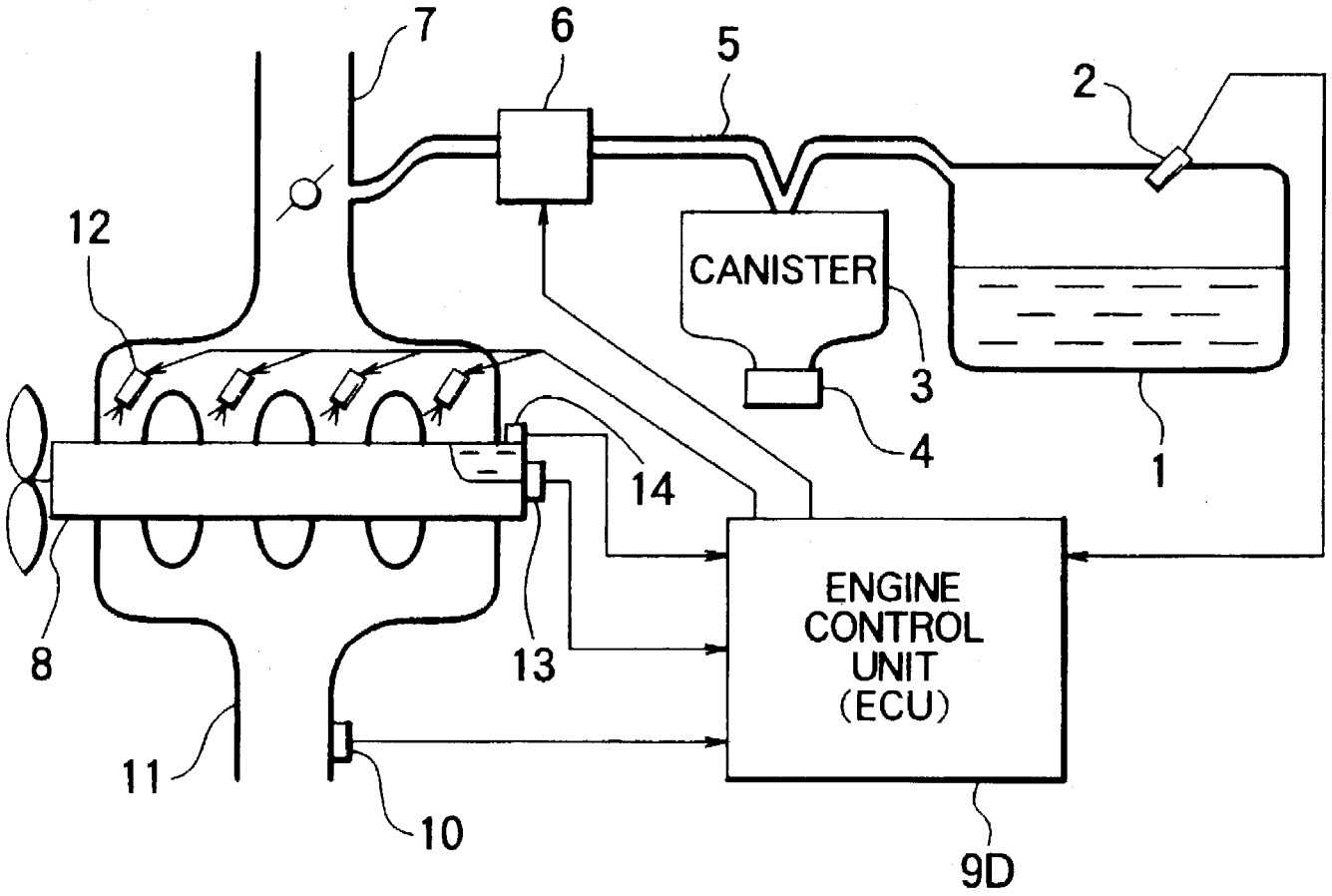
FIG. 8 is a schematic view showing the arrangement of a malfunction diagnosis device for a fuel-evaporated-gas processing device according to a fourth embodiment of the present invention.

FIG. 8 is a view showing the arrangement of a malfunction diagnosis device for a fuel-evaporated-gas processing device according to a fourth embodiment of the present invention. In FIG. 8, the same symbols as employed in FIG. 12 are used to denote corresponding components and thus a detailed description thereof is omitted.

In FIG. 8, an ECU 9D corresponds to the ECU 9 in the example shown in FIG. 12. The ECU 9D contains malfunction diagnosis means for a fuel-evaporated-gas processing device and determination processing means.

In this embodiment, a malfunction of the fuel-evaporated-gas processing device is determined after a period of time has elapsed during which the determination of a malfunction of the fuel-evaporated-gas processing device is prohibited and which depends on the temperature of engine cooling water representative of a parameter exhibiting the operating state of an engine. Here, it is to be noted that components 2–6 and the ECU 9D together constitute the fuel-evaporated-gas processing device; a component 13 and the ECU 9D together constitute a misfire detection device; and components 10, 12 and 14 and the ECU 9D together constitute a fuel device.

As described above, when a canister 3 is filled with a less amount of a fuel evaporated gas, them is a possibility that a malfunction is erroneously determined in the worst case.

The relationship between the filled amount of the fuel evaporated gas and the temperature of engine cooling water will be described below.

The amount of the fuel evaporated gas filled in the fuel tank 1 has a relationship with the temperature of fuel in the fuel tank 1, and the temperature of the fuel is increased due to the heat received by the fuel from the engine 8 after the engine 8 is started. Although a malfunction of the fuel-evaporated-gas processing device can be determined after the start of the engine as described above, a period of time required until the fuel tank 1 is fully filled with the fuel evaporated gas has a relationship with the temperature of fuel when the engine 8 starts.

It is known that the amount of the fuel evaporated gas filled in the fuel tank 1 abruptly increases when the temperature of the fuel exceeds 60° C. Accordingly, when, for example, the temperature of fuel exceeds 60° C. at the start of the engine 8, a malfunction of the fuel-evaporated-gas processing device can be determined at an earlier time after the engine start.

In this embodiment, the period of time, during which the determination of a malfunction of the fuel-evaporated-gas processing device is prohibited after the start of the engine 8, is determined by predicting the temperature of fuel at the start of the engine 8 from the temperature of engine cooling water at the engine.

Figure 9:
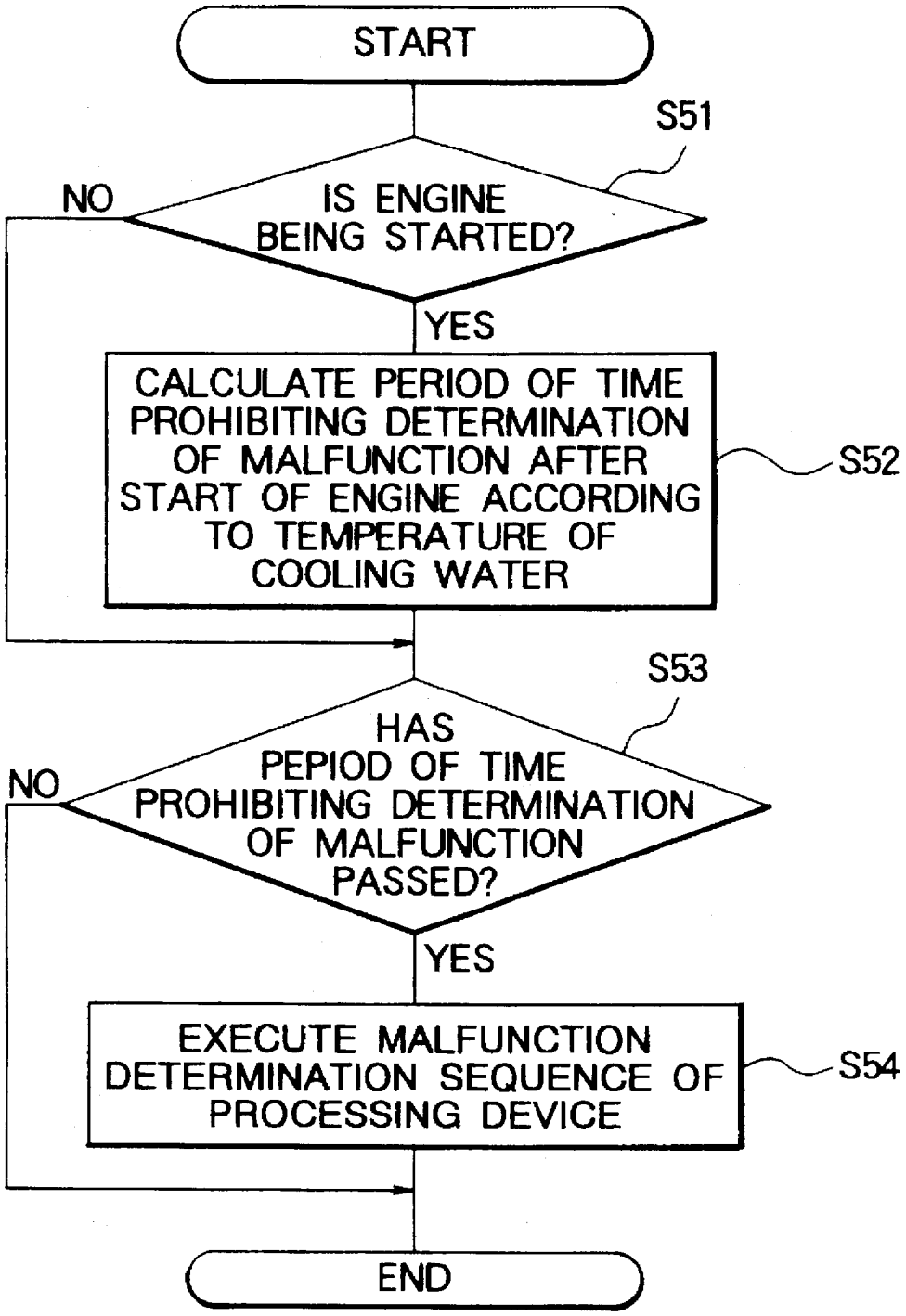
FIG. 9 is a flowchart explaining the operation of the fourth embodiment.

FIG. 9 is a flowchart of the operation of the ECU 9D.

First, it is determined whether the engine 8 is being started or not (step S51). since a start switch or a key switch (not shown) is usually turned on and connected to the ECU 9D for engine starting, when the start switch is turned on, it is determined that the engine is being started. When the engine is being started, the temperature of the cooling water of the engine 8 is detected based on an output from a water temperature sensor 14, and the period of time, during which the determination of a malfunction of the fuel-evaporated-gas processing device is prohibited after the engine start, is calculated in accordance With the temperature of the cooling water (step S52). Here, it is to be noted that a memory table (not shown) representative of the relationship between the temperature of cooling water and the period of time prohibiting the determination of malfunction may be used. Further, when the engine 8 is not being started at step S51, the process goes to step S53.

Next, it is determined whether the period of time prohibiting the determination of malfunction has elapsed or not after the start of the engine 8 (step S53), and the malfunction determination sequence of the fuel-evaporated-gas processing device is executed according to the flowchart of FIG. 9 after the lapse of the period of time prohibiting the determination of malfunction (step S54). Further, when the period of time prohibiting the determination of malfunction has not elapsed at step S53, the process is ended at once without executing the malfunction determination sequence for the fuel-evaporated-gas processing device.

As described above, according to this embodiment, the period of time, during which the determination of a malfunction of the fuel-evaporated-gas processing device is prohibited after the start of the engine 8, is determined by predicting the temperature of fuel at the engine start from the temperature of cooling water at that time, and the determination of a malfunction of the fuel-evaporated-gas processing device is executed after the period of time has elapsed. As a result, the malfunction can be determined in an accurate manner.

Embodiment 5

Figure 10:
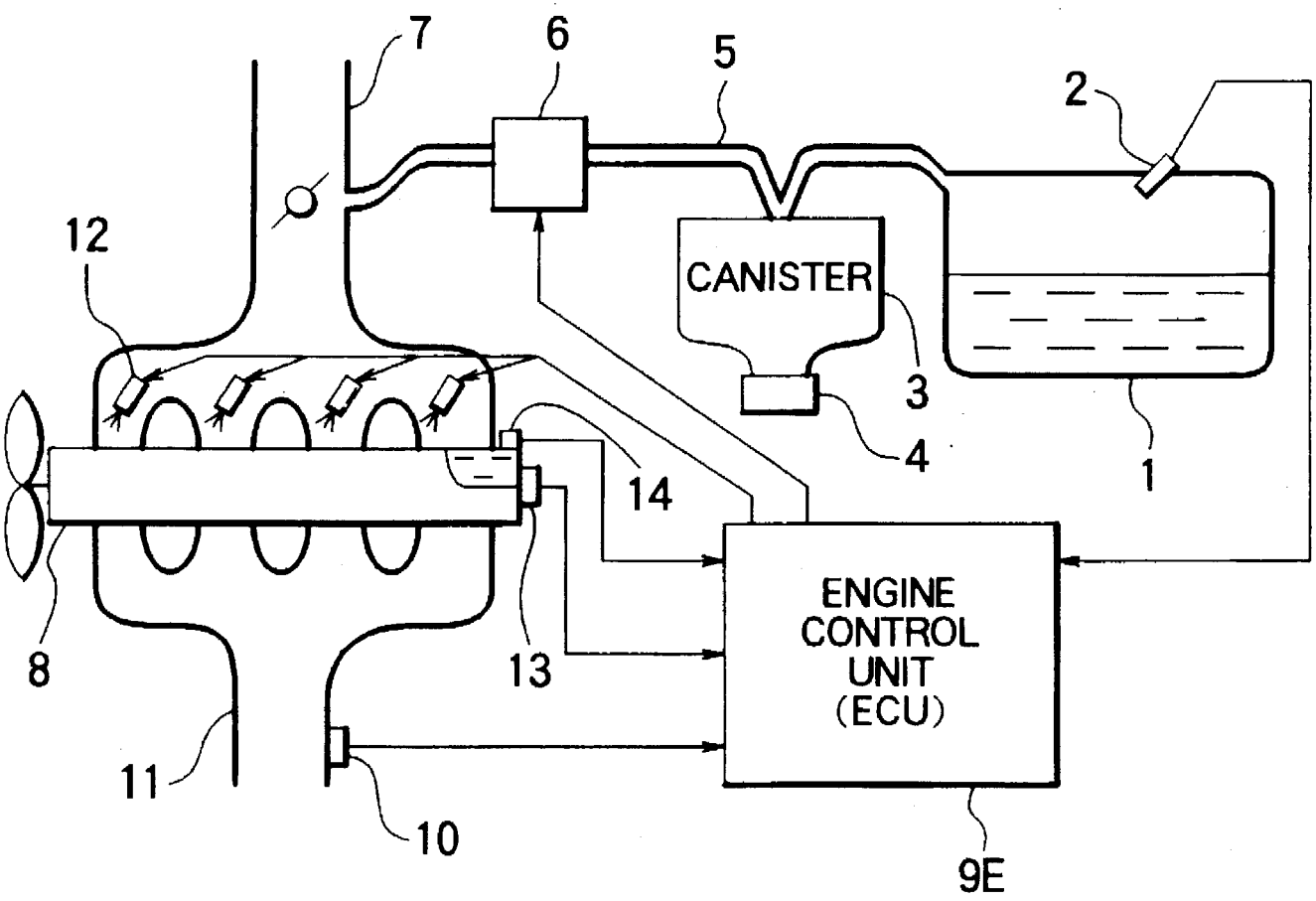
FIG. 10 is a schematic view showing the arrangement of a malfunction diagnosis device for a fuel-evaporated-gas processing device according to a fifth embodiment of the present invention.

FIG. 10 is a view showing the arrangement of a malfunction diagnosis device for a fuel-evaporated-gas processing device according to a fifth embodiment of the present invention. In FIG. 10, the same symbols as employed in FIG. 12 are used to denote corresponding components and therefore a detailed description thereof is omitted.

In FIG. 10, an ECU 9E corresponds to the ECU 9 in the example shown in FIG. 12. The ECU 9E contains malfunction diagnosis means for a fuel-evaporated-gas processing device and determination processing means.

In this embodiment, a malfunction of the fuel-evaporated-gas processing device is determined after an integrated value of an amount of intake air has exceeded a predetermined value. In this regard, it is to be noted that components 2–6 and the ECU 9E together constitute the fuel-evaporated-gas processing device; a component 13 and the ECU 9E together constitute a misfire detection device; and components 10, 12 and 14 and the ECU 9E together constitute a fuel device.

Here, the relationship between the amount of a fuel evaporated gas filled in a fuel tank 1 and a total sum of intake air sucked in an engine 8 will be described below.

The fuel evaporated gas is a gas or vapor evaporated from fuel in the fuel tank 1, and therefore when the fuel has a high temperature, the fuel is liable to evaporate and a lot of the fuel evaporated gas is naturally generated.

The temperature of the fuel is the same as that of the atmosphere when the engine 8 is out of operation for a long time, and when the engine 8 is in operation, the temperature of the fuel is increased by the heat of the engine 8 which acts as a heat source. Since fuel sucked into the engine 8 is mixed with intake air for effective combustion, when a larger amount of intake air is sucked into the engine 8, a larger amount of heat is transmitted to the fuel tank 1 and hence the fuel therein so an amount of the fuel evaporated gas generated in the fuel tank 1 increases.

In this embodiment, the lowering of malfunction detectability resulting from the fact that a canister 3 is not sufficiently filled with the fuel evaporated gas is prevented in such a manner that a malfunction of the fuel-evaporated-gas processing device is determined or checked after it is confirmed that the engine 8 has generated a sufficient amount of heat to evaporate the fuel in the fuel tank 1 by sucking a sufficient amount of air by which it is contemplated that an amount of the fuel evaporated gas purged from the fuel tank 1 has been accumulated in the canister 3 to a level enough to enable an accurate detection of malfunction after the start of the engine 8.

Figure 11:
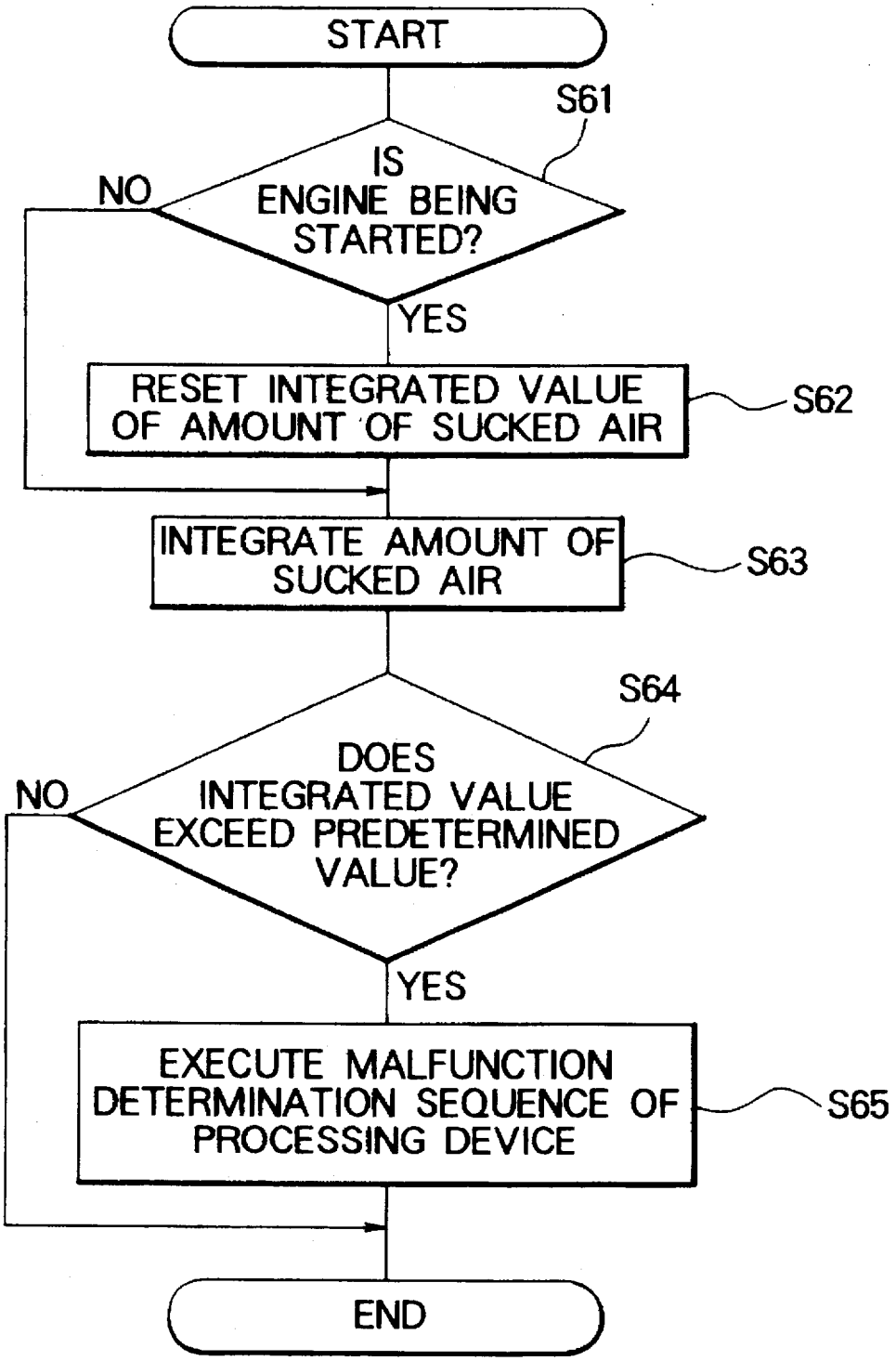
FIG. 11 is a flowchart explaining the operation of the fifth embodiment.

FIG. 11 is a flowchart showing the operation of the ECU 9E.

First, it is determined whether the engine 8 is being started or not (step S61). When the engine 8 is being started, an integrated value of an amount of air sucked by the engine 8 is reset (step S62). On the other hand, wherein the engine 8 is not being started at step S61, the process goes to step S63. Then, an amount of sucked air is integrated (step S63) and it is determined whether the integrated value is equal to or greater than a predetermined value or not (step S64). The predetermined value is preset to an amount of air by which it is contemplated that the amount of the fuel evaporated gas purged from the fuel tank 1 and accumulated in the canister 3 reaches a value enabling an accurate detection of malfunction.

After the integrated value has become greater than the predetermined value at step S64, the malfunction determination sequence for the fuel-evaporated-gas processing device is executed according to the flowchart of FIG. 11 (step S65). On the other hand, when the integrated value is less than the predetermined value at step S64, the process is ended at once without executing the malfunction determination sequence for the fuel-evaporated-gas processing device.

As described above, according to this embodiment, a malfunction of the fuel-evaporated-gas processing device is determined after it is confirmed that the engine 8 generates a sufficient amount of heat by sucking an amount of air by which it is contemplated that the amount of the fuel evaporated gas purged from the fuel tank 1 and accumulated in the canister 3 reaches a value enough to enable an accurate detection of malfunction after the start of the engine. As a result, the determination of malfunction can be made in a reliable manner.

The above-mentioned first to third embodiments and the sixth and seventh embodiments, which regulate the operation of the fuel-evaporated-gas processing device based on the operating states of the other exhaust-gas-related-components, may be combined with the fourth and fifth embodiments, respectively, which regulate the operation of the fuel-evaporated-gas processing device in relation to the operating state of the engine.

Further, although the above-mentioned respective embodiments describe the cases in which the present invention is applied to the vehicle engine, the present invention is not limited by it and may be applied to, for example, the engines of a vessel, air plane and the like in the same way with the same advantage.

What is claimed is:

1. A malfunction diagnosis device for a fuel-evaporated-gas processing device which absorbs a fuel evaporated gas in a fuel tank to an absorbing agent and supplies the fuel evaporated gas thus absorbed to an engine through a fuel-evaporated-gas passage with a valve disposed therein, said malfunction diagnosis device comprising:

malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for prohibiting the determination of a malfunction of said fuel-evaporated-gas processing device while a malfunction of an exhaust gas-related-component other than said fuel-evaporated-gas processing device is checked, wherein when one of said exhaust-gas-related components other than said fuel-evaporated-gas processing device malfunction said determination processing means invalidates the result of a determination of malfunction of said fuel-evaporated-gas processing device which has been effected in the same malfunction checking cycle.

2. A malfunction diagnosis device for a fuel-evaporated-gas processing device according to claim 1, wherein when any of said exhaust-gas-related-components other than said fuel-evaporated-gas processing device malfunctions, said determination processing means stops a malfunction determination processing for said fuel-evaporated-gas processing device.

3. A malfunction diagnosis device for a fuel-evaporated-gas processing device according to claim 1, wherein said exhaust-gas-related-components comprise a fuel device, a misfire detection device and an $O_2$ sensor.

4. A malfunction diagnosis device for a fuel-evaporated-gas processing device according to claim 1, wherein said malfunction determination means determines a period of time for prohibiting the determination of malfunction after the start of said engine based on an operating state of said engine, and prohibits the determination of a malfunction of said fuel-evaporated-gas processing device for said period of time after the engine starting.

5. A malfunction diagnosis device for a fuel-evaporated-gas processing device according to claim 1, wherein said malfunction determination means determines a period of time for prohibiting the determination of malfunction after the start of said engine based on an integrated value of an amount of air sucked by said engine after the start thereof, and prohibits the determination of a malfunction of said fuel-evaporated-gas processing device for said period of time after the engine starting.

6. A malfunction diagnosis device for a fuel-evaporated-gas processing device according to claim 1, wherein said malfunction determination means determines a period of time for prohibiting the determination of malfunction after the start of said engine based on at least one of an operating state of said engine and an integrated value of an amount of air sucked by said engine after the start thereof, and prohibits the determination of a malfunction of said fuel-evaporated gas processing device for said period of time after the engine starting.

7. A malfunction diagnosis device for a fuel-evaporated-gas processing device which absorbs a fuel evaporated gas in a fuel tank to an absorbing agent and supplying the fuel evaporated gas thus absorbed to an engine through a fuel-evaporated-gas passage with a valve disposed therein, said malfunction diagnosis device comprising:

malfunction determination means for determining a malfunction of said fuel-evaporated-gas processing device based on pressures in said fuel tank detected when said valve is opened and closed or an amount of change in an air/fuel ratio of a air/fuel mixture supplied to said engine; and determination processing means for invalidating, when any of exhaust-gas-related-components other than said fuel-evaporated-gas processing device malfunctions, the result of the determination of a malfunction of said fuel-evaporated-gas processing device which has been effected in the same malfunction checking cycle.

8. A malfunction diagnosis device for a fuel-evaporated-gas processing device according to claim 7, wherein said determination processing means stops a malfunction determination processing for said fuel-evaporated-gas processing device when any of said exhaust-gas-related-components other than said fuel-evaporated-gas processing device malfunctions.

9. A malfunction diagnosis device for a fuel-evaporated-gas processing device according to claim 7, wherein said exhaust-gas-related-components comprises a fuel device, a misfire detection device and an $O_2$ sensor.

10. A malfunction diagnosis device for a fuel-evaporated-gas processing device according to claim 7, wherein said malfunction determination means determines a period of time for prohibiting the determination of malfunction after the start of said engine based on an operating state of said engine, and prohibits the determination of a malfunction of said fuel-evaporated-gas processing device for said period of time after the engine starting.

11. A malfunction diagnosis device for a fuel-evaporated-gas processing device according to claim 7, wherein said malfunction determination means determines a period of time for prohibiting the determination of malfunction after the start of said engine based on an integrated value of an amount of air sucked by said engine after the start thereof, and prohibits the determination of a malfunction of said fuel-evaporated-gas processing device for said period of time after the engine starting.

12. A malfunction diagnosis device for a fuel-evaporated-gas processing device according to claim 7, wherein said malfunction determination means determines a period of time for prohibiting the determination of malfunction after the start of said engine based on at least one of an operating state of said engine and an integrated value of an amount of air sucked by said engine after the start thereof, and prohibits the determination of a malfunction of said fuel-evaporated-gas processing device for said period of time after the engine starting.

13. A malfunction diagnosis device for a fuel-evaporated-gas processing device which absorbs a fuel evaporated gas in a fuel tank to an absorbing agent and supplying the fuel evaporated gas thus absorbed to an engine through a fuel-evaporated-gas passage with a valve disposed therein, said malfunction diagnosis device comprising:

malfunction determination means for determining a malfunction of said fuel-evaporated-gas processing device based on pressures in said fuel tank detected when said valve are opened and closed or an amount of change in an air/fuel ratio of an air/fuel mixture supplied to said engine; and determination processing means for stopping a malfunction determination processing for said fuel-evaporated-gas processing device when any of exhaust-gas-related-components other than said fuel-evaporated-gas processing device malfunctions.

14. A malfunction diagnosis device for a fuel-evaporated-gas processing device according to claim 13, wherein said exhaust-gas-related-components comprise a fuel device, a misfire detection device and an $O_2$ sensor.

15. A malfunction diagnosis device for a fuel-evaporated-gas processing device according to claim 13, wherein said malfunction determination means determines a period of time for prohibiting the determination of malfunction after the start of said engine based on an operating state of said engine, and prohibits the determination of a malfunction of said fuel-evaporated-gas processing device for said period of time after the engine starting.

16. A malfunction diagnosis device for a fuel-evaporated-gas processing device according to claim 13, wherein said malfunction determination means determines a period of time for prohibiting the determination of malfunction after the start of said engine based on an integrated value of an amount of air sucked by said engine after the start thereof, and prohibits the determination of a malfunction of said fuel-evaporated-gas processing device for said period of time after the engine starting.

17. A malfunction diagnosis device for a fuel-evaporated-gas processing device according to claim 13, wherein said malfunction determination means determines a period of time for prohibiting the determination of malfunction after the start of said engine based on at least one of an operating state of said engine and an integrated value of an amount of air sucked by said engine after the start thereof, and prohibits the determination of a malfunction of said fuel-evaporated-gas processing device for said period of time after the engine starting.

18. A malfunction diagnosis device for a fuel-evaporated-gas processing device which absorbs a fuel evaporated gas in a fuel tank to an absorbing agent and supplying the fuel evaporated gas thus absorbed to an engine through a fuel-evaporated-gas passage with a valve disposed therein, said malfunction diagnosis device comprising:

malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for determining a period of time for prohibiting the determination of malfunction after the start of said engine based on an operating state of said engine, said determination processing means being operable to prohibit the determination of a malfunction of said fuel-evaporated-gas processing device for said period of time after the engine starting.

19. A malfunction diagnosis device for a fuel-evaporated-gas processing device which absorbs a fuel evaporated gas in a fuel tank to an absorbing agent and supplies the fuel evaporated gas thus absorbed to an engine through a fuel-evaporated-gas passage with a valve disposed therein, said malfunction diagnosis device comprising:

malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for determining a period of time for prohibiting the determination of malfunction after the start of said engine based on an integrated value of an amount of air sucked by said engine after the start thereof, said determination processing means being operable to prohibit the determination of a malfunction of said fuel-evaporated-gas processing device for said period of time after the engine starting.

20. A malfunction diagnosis device for a fuel-evaporated-gas processing device which absorbs a fuel evaporated gas in a fuel tank to an absorbing agent and supplies the fuel evaporated gas thus absorbed to an engine through a fuel-evaporated-gas passage with a valve disposed therein, said malfunction diagnosis device comprising:

malfunction determination means for determining a malfunction of said fuel-evaporated-gas processing device based on pressures in said fuel tank detected when said valve is opened and closed or an amount of change in an air/fuel ratio of an air/fuel mixture supplied to said engine; and determination processing means for determining a period of time for prohibiting the determination of malfunction after the start of said engine based on at least one of an operating state of said engine and an integrated value of an amount of air sucked by said engine after the start thereof, said determination processing means being operable to prohibit the determination of a malfunction of said fuel-evaporated-gas processing device for said period of time after the engine starting.

21. A malfunction diagnosis device for a fuel evaporated-gas processing device according to any one of claims 4, 6, 10, 12, 15, 17, 18 and 20, wherein a temperature of cooling water of said engine is used as a parameter for detecting an operating state of said engine after the start thereof.

* * * * *